US009341084B2

(12) United States Patent
Xie et al.

(10) Patent No.: US 9,341,084 B2
(45) Date of Patent: May 17, 2016

(54) SUPERCRITICAL CARBON DIOXIDE POWER CYCLE FOR WASTE HEAT RECOVERY

(71) Applicant: Echogen Power Systems, LLC, Akron, OH (US)

(72) Inventors: Tao Xie, Copley, OH (US); Michael Vermeersch, Hamilton, OH (US); Timothy Held, Akron, OH (US)

(73) Assignee: Echogen Power Systems, LLC, Akron, OH (US)

( * ) Notice: Subject to any disclaimer, the term of this patent is extended or adjusted under 35 U.S.C. 154(b) by 0 days.

(21) Appl. No.: 14/051,433

(22) Filed: Oct. 10, 2013

(65) Prior Publication Data

US 2014/0102101 A1 Apr. 17, 2014

Related U.S. Application Data

(60) Provisional application No. 61/712,907, filed on Oct. 12, 2012.

(51) Int. Cl.
*F01K 7/32* (2006.01)
*F01K 25/10* (2006.01)

(52) U.S. Cl.
CPC ..... *F01K 7/32* (2013.01); *F01K 25/103* (2013.01)

(58) Field of Classification Search
CPC ..... F01K 7/32; F01K 25/103; F01K 15/04; F01K 23/065; F01K 23/10; F01K 25/08
USPC ..... 60/647, 671, 676, 677
See application file for complete search history.

(56) References Cited

U.S. PATENT DOCUMENTS 2,575,478 A 11/1951 Wilson
2,634,375 A 4/1953 Guimbal
(Continued)

FOREIGN PATENT DOCUMENTS

CA 2794150 A1 11/2011
CN 1165238 A 11/1997
(Continued)

OTHER PUBLICATIONS

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.
(Continued)

*Primary Examiner* — Jesse Bogue
*Assistant Examiner* — Kelsey Stanek
(74) *Attorney, Agent, or Firm* — Edmonds & Nolte, PC

(57) ABSTRACT

Aspects of the invention disclosed herein generally provide heat engine systems and methods for recovering energy, such as by generating electricity from thermal energy. In one configuration, a heat engine system contains a working fluid (e.g., sc-$CO_2$) within a working fluid circuit, two heat exchangers configured to be thermally coupled to a heat source (e.g., waste heat), two expanders, two recuperators, two pumps, a condenser, and a plurality of valves configured to switch the system between single/dual-cycle modes. In another aspect, a method for recovering energy may include monitoring a temperature of the heat source, operating the heat engine system in the dual-cycle mode when the temperature is equal to or greater than a threshold value, and subsequently, operating the heat engine system in the single-cycle mode when the temperature is less than the threshold value.

13 Claims, 3 Drawing Sheets

(56) References Cited

U.S. PATENT DOCUMENTS

| | | | | |
|---|---|---|---|---|
| 2,691,280 | A | | 10/1954 | Albert |
| 3,095,274 | A | | 6/1963 | Crawford |
| 3,105,748 | A | | 10/1963 | Stahl |
| 3,237,403 | A | | 3/1966 | Feher |
| 3,277,955 | A | | 10/1966 | Laszlo |
| 3,401,277 | A | | 9/1968 | Larson |
| 3,622,767 | A | | 11/1971 | Koepcke |
| 3,630,022 | A | | 12/1971 | Jubb |
| 3,736,745 | A | | 6/1973 | Karig |
| 3,772,879 | A | | 11/1973 | Engdahl |
| 3,791,137 | A | | 2/1974 | Jubb |
| 3,830,062 | A | * | 8/1974 | Morgan et al. ..... 60/618 |
| 3,939,328 | A | | 2/1976 | Davis |
| 3,971,211 | A | | 7/1976 | Wethe |
| 3,982,379 | A | | 9/1976 | Gilli |
| 3,998,058 | A | | 12/1976 | Park |
| 4,009,575 | A | | 3/1977 | Hartman, Jr. |
| 4,029,255 | A | | 6/1977 | Heiser |
| 4,030,312 | A | | 6/1977 | Wallin |
| 4,049,407 | A | | 9/1977 | Bottum |
| 4,070,870 | A | | 1/1978 | Bahel |
| 4,099,381 | A | | 7/1978 | Rappoport |
| 4,119,140 | A | | 10/1978 | Cates |
| 4,150,547 | A | | 4/1979 | Hobson |
| 4,152,901 | A | | 5/1979 | Munters |
| 4,164,848 | A | | 8/1979 | Gilli |
| 4,164,849 | A | | 8/1979 | Mangus |
| 4,170,435 | A | | 10/1979 | Swearingen |
| 4,182,960 | A | | 1/1980 | Reuyl |
| 4,183,220 | A | | 1/1980 | Shaw |
| 4,198,827 | A | | 4/1980 | Terry et al. |
| 4,208,882 | A | | 6/1980 | Lopes |
| 4,221,185 | A | | 9/1980 | Scholes |
| 4,233,085 | A | | 11/1980 | Roderick |
| 4,236,869 | A | | 12/1980 | Laurello |
| 4,248,049 | A | | 2/1981 | Briley |
| 4,257,232 | A | | 3/1981 | Bell |
| 4,287,430 | A | | 9/1981 | Guido |
| 4,336,692 | A | | 6/1982 | Ecker |
| 4,347,711 | A | | 9/1982 | Noe |
| 4,347,714 | A | | 9/1982 | Kinsell |
| 4,372,125 | A | | 2/1983 | Dickenson |
| 4,384,568 | A | | 5/1983 | Palmatier |
| 4,391,101 | A | | 7/1983 | Labbe |
| 4,420,947 | A | | 12/1983 | Yoshino |
| 4,428,190 | A | | 1/1984 | Bronicki |
| 4,433,554 | A | | 2/1984 | Rojey |
| 4,439,687 | A | | 3/1984 | Wood |
| 4,439,994 | A | | 4/1984 | Briley |
| 4,448,033 | A | | 5/1984 | Briccetti |
| 4,450,363 | A | | 5/1984 | Russell |
| 4,455,836 | A | | 6/1984 | Binstock |
| 4,467,609 | A | | 8/1984 | Loomis |
| 4,467,621 | A | | 8/1984 | O'Brien |
| 4,475,353 | A | | 10/1984 | Lazare |
| 4,489,562 | A | | 12/1984 | Snyder |
| 4,489,563 | A | | 12/1984 | Kalina |
| 4,498,289 | A | | 2/1985 | Osgerby |
| 4,516,403 | A | | 5/1985 | Tanaka |
| 4,538,960 | A | | 9/1985 | Iino et al. |
| 4,549,401 | A | | 10/1985 | Spliethoff |
| 4,555,905 | A | | 12/1985 | Endou |
| 4,558,228 | A | | 12/1985 | Larjola |
| 4,573,321 | A | | 3/1986 | Knaebel |
| 4,578,953 | A | | 4/1986 | Krieger |
| 4,589,255 | A | | 5/1986 | Martens |
| 4,636,578 | A | | 1/1987 | Feinberg |
| 4,674,297 | A | | 6/1987 | Vobach |
| 4,694,189 | A | | 9/1987 | Haraguchi |
| 4,697,981 | A | | 10/1987 | Brown et al. |
| 4,700,543 | A | | 10/1987 | Krieger |
| 4,730,977 | A | | 3/1988 | Haaser |
| 4,756,162 | A | | 7/1988 | Dayan |
| 4,765,143 | A | | 8/1988 | Crawford |
| 4,773,212 | A | | 9/1988 | Griffin |
| 4,798,056 | A | | 1/1989 | Franklin |
| 4,813,242 | A | | 3/1989 | Wicks |
| 4,821,514 | A | | 4/1989 | Schmidt |
| 4,867,633 | A | | 9/1989 | Gravelle |
| 4,892,459 | A | | 1/1990 | Guelich |
| 4,986,071 | A | | 1/1991 | Voss |
| 4,993,483 | A | | 2/1991 | Harris |
| 5,000,003 | A | | 3/1991 | Wicks |
| 5,050,375 | A | | 9/1991 | Dickinson |
| 5,083,425 | A | | 1/1992 | Hendriks et al. |
| 5,098,194 | A | | 3/1992 | Kuo |
| 5,102,295 | A | | 4/1992 | Pope |
| 5,104,284 | A | | 4/1992 | Hustak, Jr. et al. |
| 5,164,020 | A | | 11/1992 | Wagner |
| 5,176,321 | A | | 1/1993 | Doherty |
| 5,203,159 | A | | 4/1993 | Koizumi |
| 5,228,310 | A | | 7/1993 | Vandenberg |
| 5,291,960 | A | | 3/1994 | Brandenburg |
| 5,320,482 | A | | 6/1994 | Palmer et al. |
| 5,335,510 | A | | 8/1994 | Rockenfeller |
| 5,358,378 | A | | 10/1994 | Holscher |
| 5,360,057 | A | | 11/1994 | Rockenfeller |
| 5,392,606 | A | | 2/1995 | Labinov |
| 5,440,882 | A | | 8/1995 | Kalina |
| 5,444,972 | A | | 8/1995 | Moore |
| 5,483,797 | A | | 1/1996 | Rigal et al. |
| 5,488,828 | A | | 2/1996 | Brossard |
| 5,490,386 | A | | 2/1996 | Keller |
| 5,503,222 | A | | 4/1996 | Dunne |
| 5,531,073 | A | | 7/1996 | Bronicki |
| 5,538,564 | A | | 7/1996 | Kaschmitter |
| 5,542,203 | A | | 8/1996 | Luoma |
| 5,570,578 | A | | 11/1996 | Saujet |
| 5,588,298 | A | | 12/1996 | Kalina |
| 5,600,967 | A | | 2/1997 | Meckler |
| 5,634,340 | A | | 6/1997 | Grennan |
| 5,647,221 | A | | 7/1997 | Garris, Jr. |
| 5,649,426 | A | | 7/1997 | Kalina |
| 5,676,382 | A | | 10/1997 | Dahlheimer |
| 5,680,753 | A | | 10/1997 | Hollinger |
| 5,738,164 | A | | 4/1998 | Hildebrand |
| 5,754,613 | A | | 5/1998 | Hashiguchi |
| 5,771,700 | A | | 6/1998 | Cochran |
| 5,789,822 | A | | 8/1998 | Calistrat |
| 5,813,215 | A | | 9/1998 | Weisser |
| 5,833,876 | A | | 11/1998 | Schnur |
| 5,862,666 | A | | 1/1999 | Liu |
| 5,873,260 | A | | 2/1999 | Linhardt |
| 5,874,039 | A | | 2/1999 | Edelson |
| 5,894,836 | A | | 4/1999 | Wu |
| 5,899,067 | A | | 5/1999 | Hageman |
| 5,903,060 | A | | 5/1999 | Norton |
| 5,918,460 | A | | 7/1999 | Connell |
| 5,941,238 | A | | 8/1999 | Tracy |
| 5,943,869 | A | | 8/1999 | Cheng |
| 5,946,931 | A | | 9/1999 | Lomax |
| 5,973,050 | A | | 10/1999 | Johnson |
| 6,037,683 | A | | 3/2000 | Lulay |
| 6,041,604 | A | | 3/2000 | Nicodemus |
| 6,058,930 | A | | 5/2000 | Shingleton |
| 6,062,815 | A | | 5/2000 | Holt |
| 6,065,280 | A | | 5/2000 | Ranasinghe |
| 6,066,797 | A | | 5/2000 | Toyomura |
| 6,070,405 | A | | 6/2000 | Jerye |
| 6,082,110 | A | | 7/2000 | Rosenblatt |
| 6,105,368 | A | | 8/2000 | Hansen |
| 6,112,547 | A | | 9/2000 | Spauschus |
| 6,129,507 | A | | 10/2000 | Ganelin |
| 6,158,237 | A | | 12/2000 | Riffat |
| 6,164,655 | A | | 12/2000 | Bothien |
| 6,202,782 | B1 | | 3/2001 | Hatanaka |
| 6,223,846 | B1 | | 5/2001 | Schechter |
| 6,233,938 | B1 | | 5/2001 | Nicodemus |
| 6,282,900 | B1 | | 9/2001 | Bell |
| 6,282,917 | B1 | | 9/2001 | Mongan |
| 6,295,818 | B1 | | 10/2001 | Ansley |
| 6,299,690 | B1 | | 10/2001 | Mongeon |
| 6,341,781 | B1 | | 1/2002 | Matz |
| 6,374,630 | B1 | | 4/2002 | Jones |

(56) References Cited

U.S. PATENT DOCUMENTS 6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,539,720 B2 4/2003 Rouse et al.
6,539,728 B2 4/2003 Korin
6,571,548 B1 6/2003 Bronicki
6,581,384 B1 6/2003 Benson
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,533 B2 4/2006 Lewis-Aburn et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 * 2/2010 Sundel ..... 60/671
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
7,997,076 B2 8/2011 Ernst
8,096,128 B2 1/2012 Held et al.
8,099,198 B2 1/2012 Gurin
8,146,360 B2 4/2012 Myers
8,281,593 B2 10/2012 Held
8,419,936 B2 4/2013 Berger et al.
8,544,274 B2 * 10/2013 Ernst ..... 60/651
2001/0015061 A1 8/2001 Viteri et al.
2001/0020444 A1 9/2001 Johnston
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0022963 A1 2/2005 Garrabrant et al.
2005/0056001 A1 3/2005 Frutschi
2005/0096676 A1 5/2005 Gifford, III et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0017192 A1 1/2007 Bednarek et al.

(56) References Cited

U.S. PATENT DOCUMENTS

| | | | |
|---|---|---|---|
| 2007/0019708 | A1 | 1/2007 | Shiflett et al. |
| 2007/0027038 | A1 | 2/2007 | Kamimura et al. |
| 2007/0056290 | A1 | 3/2007 | Dahm |
| 2007/0089449 | A1 | 4/2007 | Gurin |
| 2007/0108200 | A1 | 5/2007 | McKinzie, II |
| 2007/0119175 | A1 | 5/2007 | Ruggieri et al. |
| 2007/0130952 | A1 | 6/2007 | Copen |
| 2007/0151244 | A1 | 7/2007 | Gurin |
| 2007/0161095 | A1 | 7/2007 | Gurin |
| 2007/0163261 | A1 | 7/2007 | Strathman |
| 2007/0195152 | A1 | 8/2007 | Kawai et al. |
| 2007/0204620 | A1 | 9/2007 | Pronske et al. |
| 2007/0227472 | A1 | 10/2007 | Takeuchi et al. |
| 2007/0234722 | A1 | 10/2007 | Kalina |
| 2007/0245733 | A1 | 10/2007 | Pierson et al. |
| 2007/0246206 | A1 | 10/2007 | Gong et al. |
| 2008/0000225 | A1 | 1/2008 | Kalina |
| 2008/0006040 | A1 | 1/2008 | Peterson et al. |
| 2008/0010967 | A1 | 1/2008 | Griffin et al. |
| 2008/0023666 | A1 | 1/2008 | Gurin |
| 2008/0053095 | A1 | 3/2008 | Kalina |
| 2008/0066470 | A1 | 3/2008 | MacKnight |
| 2008/0135253 | A1 | 6/2008 | Vinegar et al. |
| 2008/0163625 | A1 | 7/2008 | O'Brien |
| 2008/0173450 | A1 | 7/2008 | Goldberg et al. |
| 2008/0211230 | A1 | 9/2008 | Gurin |
| 2008/0250789 | A1 | 10/2008 | Myers et al. |
| 2008/0252078 | A1 | 10/2008 | Myers |
| 2009/0021251 | A1 | 1/2009 | Simon |
| 2009/0085709 | A1 | 4/2009 | Meinke |
| 2009/0107144 | A1 | 4/2009 | Moghtaderi et al. |
| 2009/0139234 | A1 | 6/2009 | Gurin |
| 2009/0139781 | A1 | 6/2009 | Straubel |
| 2009/0173337 | A1 | 7/2009 | Tamaura et al. |
| 2009/0173486 | A1 | 7/2009 | Copeland |
| 2009/0180903 | A1 | 7/2009 | Martin et al. |
| 2009/0205892 | A1 | 8/2009 | Jensen et al. |
| 2009/0211251 | A1 | 8/2009 | Peterson et al. |
| 2009/0211253 | A1 | 8/2009 | Radcliff et al. |
| 2009/0266075 | A1 | 10/2009 | Westmeier et al. |
| 2009/0293503 | A1 | 12/2009 | Vandor |
| 2010/0024421 | A1 | 2/2010 | Litwin |
| 2010/0077792 | A1 | 4/2010 | Gurin |
| 2010/0083662 | A1 | 4/2010 | Kalina |
| 2010/0102008 | A1 | 4/2010 | Hedberg |
| 2010/0122533 | A1 | 5/2010 | Kalina |
| 2010/0146949 | A1 | 6/2010 | Stobart et al. |
| 2010/0146973 | A1 | 6/2010 | Kalina |
| 2010/0156112 | A1 | 6/2010 | Held et al. |
| 2010/0162721 | A1 | 7/2010 | Welch et al. |
| 2010/0205962 | A1 | 8/2010 | Kalina |
| 2010/0218513 | A1 | 9/2010 | Vaisman et al. |
| 2010/0218930 | A1 | 9/2010 | Proeschel |
| 2010/0263380 | A1 | 10/2010 | Biederman et al. |
| 2010/0287934 | A1 | 11/2010 | Glynn et al. |
| 2010/0300093 | A1 | 12/2010 | Doty |
| 2010/0326076 | A1 | 12/2010 | Ast et al. |
| 2011/0027064 | A1 | 2/2011 | Pal et al. |
| 2011/0030404 | A1 | 2/2011 | Gurin |
| 2011/0048012 | A1 | 3/2011 | Ernst et al. |
| 2011/0061384 | A1 | 3/2011 | Held et al. |
| 2011/0061387 | A1 | 3/2011 | Held et al. |
| 2011/0088399 | A1 | 4/2011 | Briesch et al. |
| 2011/0179799 | A1 | 7/2011 | Allam et al. |
| 2011/0185729 | A1 | 8/2011 | Held |
| 2011/0192163 | A1 | 8/2011 | Kasuya |
| 2011/0203278 | A1 | 8/2011 | Kopecek et al. |
| 2011/0259010 | A1 | 10/2011 | Bronicki et al. |
| 2011/0299972 | A1 | 12/2011 | Morris |
| 2011/0308253 | A1 | 12/2011 | Ritter |
| 2012/0047892 | A1 | 3/2012 | Held et al. |
| 2012/0067055 | A1 | 3/2012 | Held |
| 2012/0128463 | A1 | 5/2012 | Held |
| 2012/0131918 | A1 | 5/2012 | Held |
| 2012/0131919 | A1 | 5/2012 | Held |
| 2012/0131920 | A1 | 5/2012 | Held |
| 2012/0131921 | A1 | 5/2012 | Held |
| 2012/0159922 | A1 | 6/2012 | Gurin |
| 2012/0159956 | A1 | 6/2012 | Gurin |
| 2012/0174558 | A1 | 7/2012 | Gurin |
| 2012/0186219 | A1 | 7/2012 | Gurin |
| 2012/0247134 | A1 | 10/2012 | Gurin |
| 2012/0247455 | A1 | 10/2012 | Gurin et al. |
| 2012/0261090 | A1 | 10/2012 | Durmaz et al. |
| 2012/0306206 | A1* | 12/2012 | Agrawal et al. ..... 290/52 |
| 2013/0019597 | A1 | 1/2013 | Kalina |
| 2013/0033037 | A1 | 2/2013 | Held et al. |
| 2013/0036736 | A1 | 2/2013 | Hart et al. |
| 2013/0113221 | A1 | 5/2013 | Held |

FOREIGN PATENT DOCUMENTS

| | | | |
|---|---|---|---|
| CN | 1432102 | A | 7/2003 |
| CN | 101614139 | A | 12/2009 |
| CN | 202055876 | U | 11/2011 |
| CN | 202544943 | U | 11/2012 |
| CN | 202718721 | U | 2/2013 |
| DE | 2632777 | A1 | 2/1977 |
| DE | 19906087 | A1 | 8/2000 |
| DE | 10052993 | A1 | 5/2002 |
| EP | 0 277 777 | B1 | 6/1992 |
| EP | 1977174 | A2 | 10/2008 |
| EP | 1998013 | A2 | 12/2008 |
| EP | 2419621 | A1 | 2/2012 |
| EP | 2446122 | A1 | 5/2012 |
| EP | 2478201 | A1 | 7/2012 |
| EP | 2500530 | A1 | 9/2012 |
| EP | 2550436 | | 1/2013 |
| GB | 856985 | A | 12/1960 |
| GB | 2010974 | A | 7/1979 |
| GB | 2075608 | A | 11/1981 |
| JP | 58-193051 | A | 11/1983 |
| JP | 60040707 | A | 3/1985 |
| JP | 61-152914 | A | 7/1986 |
| JP | 01-240705 | A | 9/1989 |
| JP | H 03-215139 | A | 9/1991 |
| JP | 05-321612 | A | 12/1993 |
| JP | 06-331225 | A | 11/1994 |
| JP | 08028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11270352 | | 5/1999 |
| JP | 2000257407 | A | 9/2000 |
| JP | 2001-193419 | A | 7/2001 |
| JP | 2002-097965 | A | 4/2002 |
| JP | 2003529715 | A | 10/2003 |
| JP | 2004-239250 | A | 8/2004 |
| JP | 2004-332626 | A | 11/2004 |
| JP | 2005030727 | A | 2/2005 |
| JP | 2005-533972 | A1 | 11/2005 |
| JP | 2006037760 | A | 2/2006 |
| JP | 2006177266 | A | 7/2006 |
| JP | 2007-198200 | A | 9/2007 |
| JP | 4343738 | B2 | 10/2009 |
| JP | 2011-017268 | A | 1/2011 |
| KR | 100191080 | | 6/1999 |
| KR | 10-2007-0086244 | A | 8/2007 |
| KR | 10-0766101 | B1 | 10/2007 |
| KR | 10-0844634 | A | 7/2008 |
| KR | 10-20100067927 | A | 6/2010 |
| KR | 1020110018769 | A | 2/2011 |
| KR | 1069914 | B1 | 9/2011 |
| KR | 1103549 | B1 | 1/2012 |
| KR | 10-2012-0058582 | A | 6/2012 |
| KR | 2012-0068670 | A | 6/2012 |
| KR | 2012-0128753 | A | 11/2012 |
| KR | 2012-0128755 | A | 11/2012 |
| WO | WO 91/05145 | | 4/1991 |
| WO | WO 96/09500 | A1 | 3/1996 |
| WO | 0071944 | A1 | 11/2000 |
| WO | WO 01/44658 | A1 | 6/2001 |
| WO | WO 2006/060253 | | 6/2006 |

(56) References Cited

FOREIGN PATENT DOCUMENTS

| | | | |
|---|---|---|---|
| WO | WO 2006/137957 | A1 | 12/2006 |
| WO | WO 2007/056241 | A2 | 5/2007 |
| WO | WO 2007/079245 | A2 | 7/2007 |
| WO | WO 2007/082103 | A2 | 7/2007 |
| WO | WO 2007/112090 | A2 | 10/2007 |
| WO | WO 2008/039725 | A2 | 4/2008 |
| WO | 2008101711 | A2 | 8/2008 |
| WO | WO 2009/045196 | A1 | 4/2009 |
| WO | WO 2009/058992 | A2 | 5/2009 |
| WO | 2010083198 | A1 | 7/2010 |
| WO | WO 2010/074173 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | WO 2012/074905 | A2 | 6/2012 |
| WO | WO 2012/074907 | A2 | 6/2012 |
| WO | WO 2012/074911 | A2 | 6/2012 |
| WO | WO 2012/074940 | A2 | 6/2012 |
| WO | WO 2013/055391 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |

OTHER PUBLICATIONS

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).

Chordia, Lalit, "Optimizing Equipment for Supercritical Applications", Thar Energy LLC, Supercritical CO2 Power Cycle Symposium, May 24-25, 2011, Boulder, CO, 7 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., A Supercritical Carbon Dioxide Cycle for Next Generation Nuclear Reactors, Mar. 10, 2004, 326 pages., (7 parts).

Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, 2009, Troy, NY, 8 pages.

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.

Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.

Feher, E.G., et al., "Investigation of Supercritical (Feher) Cycle", Astropower Laboratory, Missile & Space Systems Division, Oct. 1968, 152 pages.

Fuller, Robert L., and Eisemann, Kevin, "Centrifugal Compressor Off-Design Performance for Super-Critical CO2" , Barber Nichols, Inc. Presentation, Supercritical CO2 Power Cycle Symposium, May 24-25, 2011, Boulder, CO, 20 pages.

Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.

Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.

Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.

Hejzlar, P. et al.., "Assessment of Gas Cooled Gas Reactor with Indirect Supercritical CO2 Cycle" Massachusetts Institute of Technology, Jan. 2006, 10 pages.

Hoffman, John R., and Feher, E.G, "150 kwe Supercritical Closed Cycle System", Transactions of the ASME, Jan. 1971, pp. 70-80.

Jeong, Woo Seok, et al., "Performance of S—CO2 Brayton Cycle with Additive Gases for SFR Application", Korea Advanced Institute of Science and Technology, Supercritical CO2 Power Cycle Symposium, May 24-25, 2011, Boulder, CO, 5 pages.

Johnson, Gregory A., & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.

Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).

Kulhanek, Martin, "Thermodynamic Analysis and Comparison of S—CO2 Cycles", Presentation, Czech Technical University in Prague, Supercritical CO2 Power Cycle Symposium, May 24-25, 2011, Boulder, CO, 14 pages.

Kulhanek, Martin, "Thermodynamic Analysis and Comparison of S—CO2 Cycles", Paper, Czech Technical University in Prague, Supercritical CO2 Power Cycle Symposium, May 24-25, 2011, Boulder, CO, 7 pages.

Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.

Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.

Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.

(56) References Cited

OTHER PUBLICATIONS

Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering-2007, Oct. 23-27, 2007, Hangzhou, China, pp. 86-87.
Noriega, Bahamonde J.S., "Design Method for s—CO2 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 7 pages.
PCT/US2007/079318—International Preliminary Report on Patentability dated Jul. 7, 2008, 5 pages.
PCT/US2010/031614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and Written Opinion of the International Searching Authority, or the Declaration dated Sep. 1, 2010, 6 pages.
PCT/US2010/044476—International Search Report dated Sep. 29, 2010, 23 pages.
PCT/US2010/044681—International Search Report and Written Opinion mailed Oct. 7, 2010, 10 pages.
PCT/US2010/044681—International Preliminary Report on Patentability dated Feb. 16, 2012, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2011/029486—International Preliminary Report on Patentability dated Sep. 25, 2012, 6 pages.
PCT/US2011/029486—International Search Report and Written Opinion dated Nov. 16, 2011, 9 pages.
PCT/US2011/062266—International Search Report and Written Opinion dated Jul. 9, 2012, 12 pages.
PCT/US2011/062198 (EPS-070)—International Search Report and Written Opinion dated Jul. 2, 2012, 9 pages.
PCT/US2011/062201—International Search Report and Written Opinion dated Jun. 26, 2012, 9 pages.
PCT/US2011/062204—International Search Report dated Nov. 1, 2012, 10 pages.
PCT/US2011/62207—International Search Report and Written Opinion dated Jun. 28, 2012, 7 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S—CO2 Power Cycle with Reheating" Energy Conversion and Management 50 (May 17, 2009), pp. 1939-1945.
Tom, Samsun Kwok Sun, "The Feasibility of Using Supercritical Carbon Dioxide as a Coolant for the Candu Reactor", The University of British Columbia, Jan. 1978, 156 pages.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.
CN Search Report for Application No. 201080035382.1, 2 pages.
CN Search Report for Application No. 201080050795.7, 2 pages.
PCT/US2011/062198—Extended European Search Report dated May 6, 2014, 9 pages.
PCT/US2011/055547—Extended European Search Report dated May 28, 2014, 8 pages.
PCT/US2013/055547—Notification of Transmittal of the International Search Report and the Written Opinion of the International Searching Authority, or the Declaration dated Jan. 24, 2014, 11 pages.

(56) References Cited

OTHER PUBLICATIONS

PCT/US2013/064470—Notification of Transmittal of the International Search Report and the Written Opinion of the International Searching Authority, or the Declaration dated Jan. 22, 2014, 10 pages.

PCT/US2013/064471—Notification of Transmittal of the International Search Report and the Written Opinion of the International Searching Authority, or the Declaration dated Jan. 24, 2014, 10 pages.

PCT/US2014/013154—International Search Report dated May 23, 2014, 4 pages.

PCT/US2014/013170—Notification of Transmittal of the International Search Report and the Written Opinion of the International Searching Authority, or the Declaration dated May 9, 2014, 12 pages.

PCT/US2014/023026—Notification of Transmittal of the International Search Report and the Written Opinion of the International Searching Authority, or the Declaration dated Jul. 22, 2014, 11 pages.

PCT/US2014/023990—Notification of Transmittal of the International Search Report and the Written Opinion of the International Searching Authority, or the Declaration dated Jul. 17, 2014, 10 pages.

PCT/US2014/026173—Notification of Transmittal of the International Search Report and the Written Opinion of the International Searching Authority, or the Declaration dated Jul. 9, 2014, 10 pages.

Renz, Manfred, "The New Generation Kalina Cycle", Contribution to the Conference: "Electricity Generation from Enhanced Geothermal Systems", Sep. 14, 2006, Strasbourg, France, 18 pages.

Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.

* cited by examiner

SUPERCRITICAL CARBON DIOXIDE POWER CYCLE FOR WASTE HEAT RECOVERY

CROSS-REFERENCE TO RELATED APPLICATIONS

This application claims benefit of U.S. Prov. Appl. No. 61/712,907, entitled "Supercritical Carbon Dioxide Power Cycle for Waste Heat Recovery," and filed Oct. 12, 2012, which is incorporated herein by reference in its entirety to the extent consistent with the present application.

BACKGROUND

Heat is often created as a byproduct of industrial processes and is discharged when liquids, solids, and/or gasses that contain such heat are exhausted into the environment or otherwise removed from the process. This heat removal may be necessary to avoid exceeding safe and efficient operating temperatures in the industrial process equipment or may be inherent as exhaust in open cycles. Useful thermal energy is generally lost when this heat is not recovered or recycled during such processes. Accordingly, industrial processes often use heat exchanging devices to recover the heat and recycle much of the thermal energy back into the process or provide combined cycles, utilizing this thermal energy to power secondary heat engine cycles.

Waste heat recovery can be significantly limited by a variety of factors. For example, the exhaust stream may be reduced to low-grade (e.g., low temperature) heat, from which economical energy extraction is difficult, or the heat may otherwise be difficult to recover. Accordingly, the unrecovered heat is discharged as "waste heat," typically via a stack or through exchange with water or another cooling medium. Moreover, in other settings, heat is available from renewable sources of thermal energy, such as heat from the sun or geothermal sources, which may be concentrated or otherwise manipulated.

In multiple-cycle systems, waste heat is converted to useful energy via two or more components coupled to the waste heat source in multiple locations. While multiple-cycle systems are successfully employed in some operating environments, generally, multiple-cycle systems have limited efficiencies in most operating environments. In some applications, the waste heat conditions (e.g., temperature) can fluctuate, such that the waste heat conditions are temporarily outside the optimal operating range of the multiple-cycle systems. Coupling multiple, discrete cycle systems is one solution. However, multiple independent cycle systems introduce greater system complexity due to the increased number of system components, especially when the system includes additional turbo- or turbine components. Such multiple independent cycle systems are complex and have increased control and maintenance requirements, as well as additional expenses and footprint demands.

Therefore, there is a need for a heat engine system and a method for recovering energy, such that the system and method have an optimized operating range for a heat recovery power cycle, minimized complexity, and maximized efficiency for recovering thermal energy and producing mechanical energy and/or electrical energy.

SUMMARY

Embodiments of the invention generally provide heat engine systems and methods for recovering energy, such as by producing mechanical energy and/or generating electrical energy, from a wide range of thermal sources, such as a waste heat source. In one or more exemplary embodiments disclosed herein, a heat engine system contains a working fluid within a working fluid circuit having a high pressure side and a low pressure side. The working fluid generally contains carbon dioxide and at least a portion of the working fluid circuit contains the working fluid in a supercritical state. The heat engine system further contains a first heat exchanger and a second heat exchanger, such that each of the first and second heat exchangers is fluidly coupled to and in thermal communication with the high pressure side of the working fluid circuit, configured to be fluidly coupled to and in thermal communication with a heat source stream (e.g., a waste heat stream), and configured to transfer thermal energy from the heat source stream to the working fluid within the working fluid circuit. The heat engine system also contains a first expander fluidly coupled to and downstream of the first heat exchanger on the high pressure side of the working fluid circuit and a second expander fluidly coupled to and downstream of the second heat exchanger on the high pressure side of the working fluid circuit.

The heat engine system further contains a first recuperator and a second recuperator fluidly coupled to the working fluid circuit. The first recuperator may be fluidly coupled to and downstream of the first expander on the low pressure side of the working fluid circuit and fluidly coupled to and upstream of the first heat exchanger on the high pressure side of the working fluid circuit. In some embodiments, the first recuperator may be configured to transfer thermal energy from the working fluid received from the first expander to the working fluid received from the first and second pumps when the system is in the dual-cycle mode. The second recuperator may be fluidly coupled to and downstream of the second expander on the low pressure side of the working fluid circuit and fluidly coupled to and upstream of the second heat exchanger on the high pressure side of the working fluid circuit. In some embodiments, the second recuperator may be configured to transfer thermal energy from the working fluid received from the second expander to the working fluid received from the first pump when the system is in dual-cycle mode and is inactive when the system is in the single-cycle mode.

The heat engine system further contains a condenser, a first pump, and a second pump fluidly coupled to the working fluid circuit. The condenser may be fluidly coupled to and downstream of the first and second recuperators on the low pressure side of the working fluid circuit. The condenser may be configured to remove thermal energy from the working fluid passing through the low pressure side of the working fluid circuit. The condenser may also be configured to control or regulate the temperature of the working fluid circulating through the working fluid circuit. The first pump may be fluidly coupled to and downstream of the condenser on the low pressure side of the working fluid circuit and fluidly coupled to and upstream of the first and second recuperators on the high pressure side of the working fluid circuit. The second pump may be fluidly coupled to and downstream of the condenser on the low pressure side of the working fluid circuit and fluidly coupled to and upstream of the first recuperator on the high pressure side of the working fluid circuit. In some exemplary embodiments, the second pump may be a turbopump, the second expander may be a drive turbine, and the drive turbine may be coupled to the turbopump and operable to drive the turbopump when the heat engine system is in the dual-cycle mode.

In some exemplary embodiments, the heat engine system further contains a plurality of valves operatively coupled to the working fluid circuit and configured to switch the heat engine system between a dual-cycle mode and a single-cycle mode. In the dual-cycle mode, the first and second heat exchangers and the first and second pumps are active as the working fluid is circulated throughout the working fluid circuit. However, in the single-cycle mode, the first heat exchanger and the first expander are active and at least the second heat exchanger and the second pump are inactive as the working fluid is circulated throughout the working fluid circuit.

In some examples, the plurality of valves may include a valve disposed between the condenser and the second pump, wherein the valve is closed during the single-cycle mode of the heat engine system and the valve is open when the heat engine system is in the dual-cycle mode. In other examples, the plurality of valves may include a valve disposed between the first pump and the first recuperator, the valve may be configured to prohibit flow of the working fluid from the first pump to the first recuperator when the heat engine system is in the dual-cycle mode and to allow fluid flow therebetween during the single-cycle mode of the heat engine system.

In other exemplary embodiments, the plurality of valves may include five or more valves operatively coupled to the working fluid circuit for controlling the flow of the working fluid. A first valve may be operatively coupled to the high pressure side of the working fluid circuit and disposed downstream of the first pump and upstream of the second recuperator. A second valve may be operatively coupled to the low pressure side of the working fluid circuit and disposed downstream of the second recuperator and upstream of the condenser. A third valve may be operatively coupled to the high pressure side of the working fluid circuit and disposed downstream of the first pump and upstream of the first recuperator. A fourth valve may be operatively coupled to the high pressure side of the working fluid circuit and disposed downstream of the second pump and upstream of the first recuperator. A fifth valve may be operatively coupled to the low pressure side of the working fluid circuit and disposed downstream of the condenser and upstream of the second pump.

In some examples, the working fluid from the low pressure side of the first recuperator and the working fluid from the low pressure side of the second recuperator combine at a point on the low pressure side of the working fluid circuit, such that the point is disposed upstream of the condenser and downstream of the second valve. In some configurations, each of the first, second, fourth, and fifth valves may be in an opened-position and the third valve may be in a closed-position when the heat engine system is in the dual-cycle mode. Alternatively, during the single-cycle mode of the heat engine system, each of the first, second, fourth, and fifth valves may be in a closed-position and the third valve may be in an opened-position.

In other embodiments disclosed herein, the plurality of valves may be configured to actuate in response to a change in temperature of the heat source stream. For example, when the temperature of the heat source stream becomes less than a threshold value, the plurality of valves may be configured to switch the system to the single-cycle mode. Also, when the temperature of the heat source stream becomes equal to or greater than the threshold value, the plurality of valves may be configured to switch the system to the dual-cycle mode.

In other embodiments disclosed herein, the plurality of valves may be configured to switch the system between the dual-cycle mode and the single-cycle mode, such that in the dual-cycle mode, the plurality of valves may be configured to direct the working fluid from the condenser to the first and second pumps, and subsequently, direct the working fluid from the first pump to the second heat exchanger and/or direct the working fluid from the second pump to the first heat exchanger. In the single-cycle mode, the plurality of valves may be configured to direct the working fluid from the condenser to the first pump and from the first pump to the first heat exchanger, and to substantially cut-off or stop the flow of the working fluid to the second pump, the second heat exchanger, and the second expander.

In one or more embodiments disclosed herein, a method for recovering energy from a heat source (e.g., waste heat source) is provided and includes operating a heat engine system in a dual-cycle mode and subsequently switching the heat engine system from the dual-cycle mode to a single-cycle mode. In the dual-cycle mode, the method includes operating the heat engine system by heating a first mass flow of a working fluid in the first heat exchanger fluidly coupled to and in thermal communication with a working fluid circuit and a heat source stream and expanding the first mass flow in a first expander fluidly coupled to the first heat exchanger via the working fluid circuit. The first heat exchanger may be configured to transfer thermal energy from the heat source stream to the first mass flow of the working fluid within the working fluid circuit. In many exemplary embodiments, the working fluid contains carbon dioxide and at least a portion of the working fluid circuit contains the working fluid in a supercritical state.

Also, in the dual-cycle mode, the method includes heating a second mass flow of the working fluid in the second heat exchanger fluidly coupled to and in thermal communication with the working fluid circuit and the heat source stream and expanding the second mass flow in a second expander fluidly coupled to the second heat exchanger via the working fluid circuit. The second heat exchanger may be configured to transfer thermal energy from the heat source stream to the second mass flow of the working fluid within the working fluid circuit. The method further includes, in the dual-cycle mode, at least partially condensing the first and second mass flows in one or more condensers fluidly coupled to the working fluid circuit, pressurizing the first mass flow in a first pump fluidly coupled to the condenser via the working fluid circuit, and pressurizing the second mass flow in a second pump fluidly coupled to the condenser via the working fluid circuit.

In the single-cycle mode, the method includes operating the heat engine system by de-activating the second heat exchanger, the second expander, and the second pump, directing the working fluid from the condenser to the first pump, and directing the working fluid from the first pump to the first heat exchanger. The method may include de-activating the second recuperator and directing the working fluid from the second pump to the first recuperator while switching to the single-cycle mode.

In other embodiments, the method includes operating the heat engine system in the dual-cycle mode by further transferring heat via the first recuperator from the first mass flow downstream of the first expander and upstream of the condenser to the first mass flow downstream of the second pump and upstream of the first heat exchanger, transferring heat via the second recuperator from the second mass flow downstream of the second expander and upstream of the condenser to the second mass flow downstream of the first pump and upstream of the second heat exchanger, and switching to the single-cycle mode further includes de-activating the second recuperator and directing the working fluid from the second pump to the first recuperator.

In some embodiments, the method further includes monitoring a temperature of the heat source stream, operating the heat engine system in the dual-cycle mode when the temperature is equal to or greater than a threshold value, and subsequently, operating the heat engine system in the single-cycle mode when the temperature is less than the threshold value. In some examples, the threshold value of the temperature of the heat source stream is within a range from about 300° C. to about 400° C., such as about 350° C. In one aspect, the method may include automatically switching from operating the heat engine system in the dual-cycle mode to operating the heat engine system in the single-cycle mode with a programmable controller once the temperature is less than the threshold value. In another aspect, the method may include manually switching from operating the heat engine system in the dual-cycle mode to operating the heat engine system in the single-cycle mode once the temperature is less than the threshold value.

BRIEF DESCRIPTION OF THE DRAWINGS

Embodiments of the present disclosure are best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
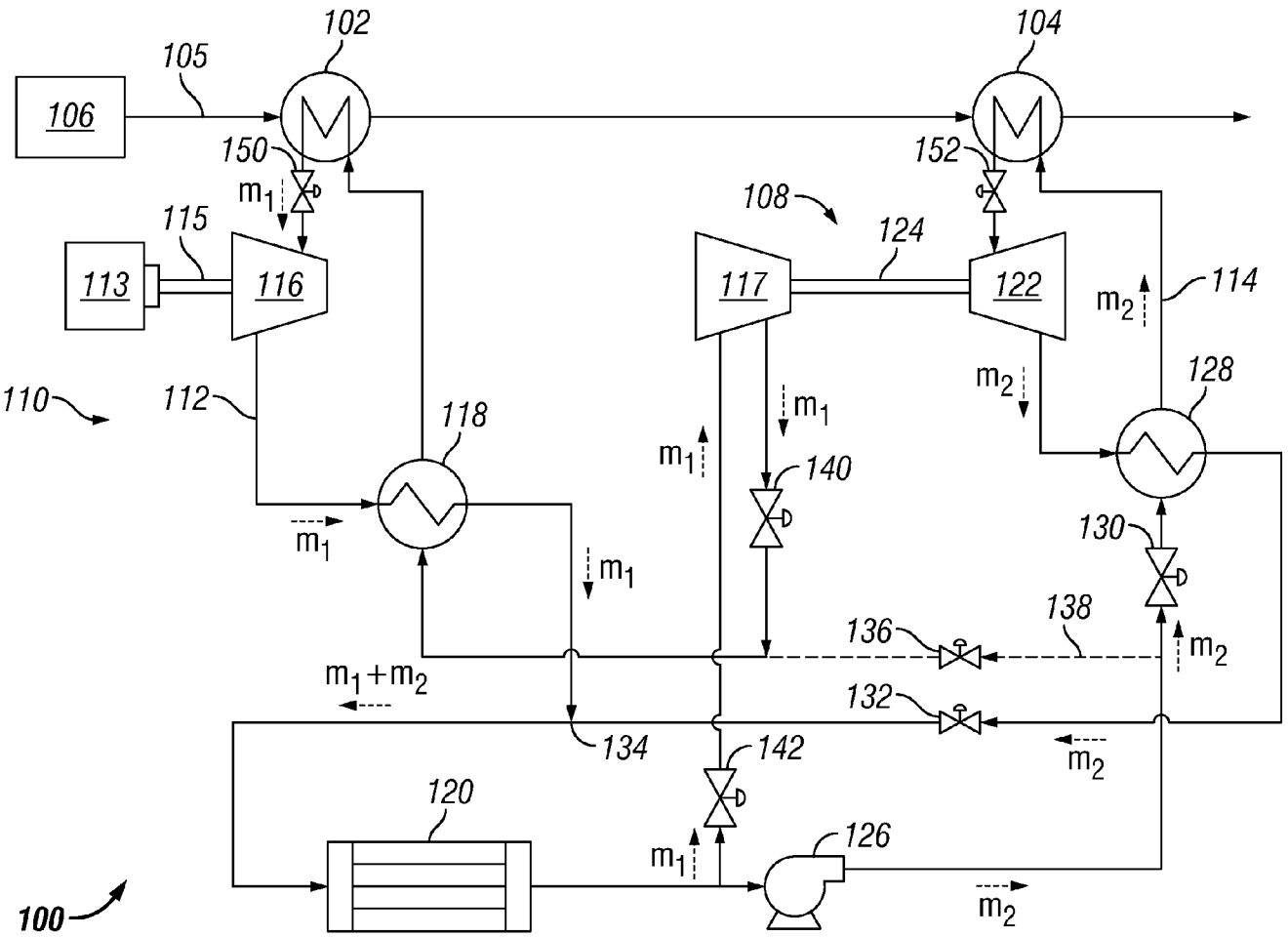
FIG. 1 schematically illustrates a heat engine system, operating in dual-cycle mode, according to exemplary embodiments described herein.
Figure 2:
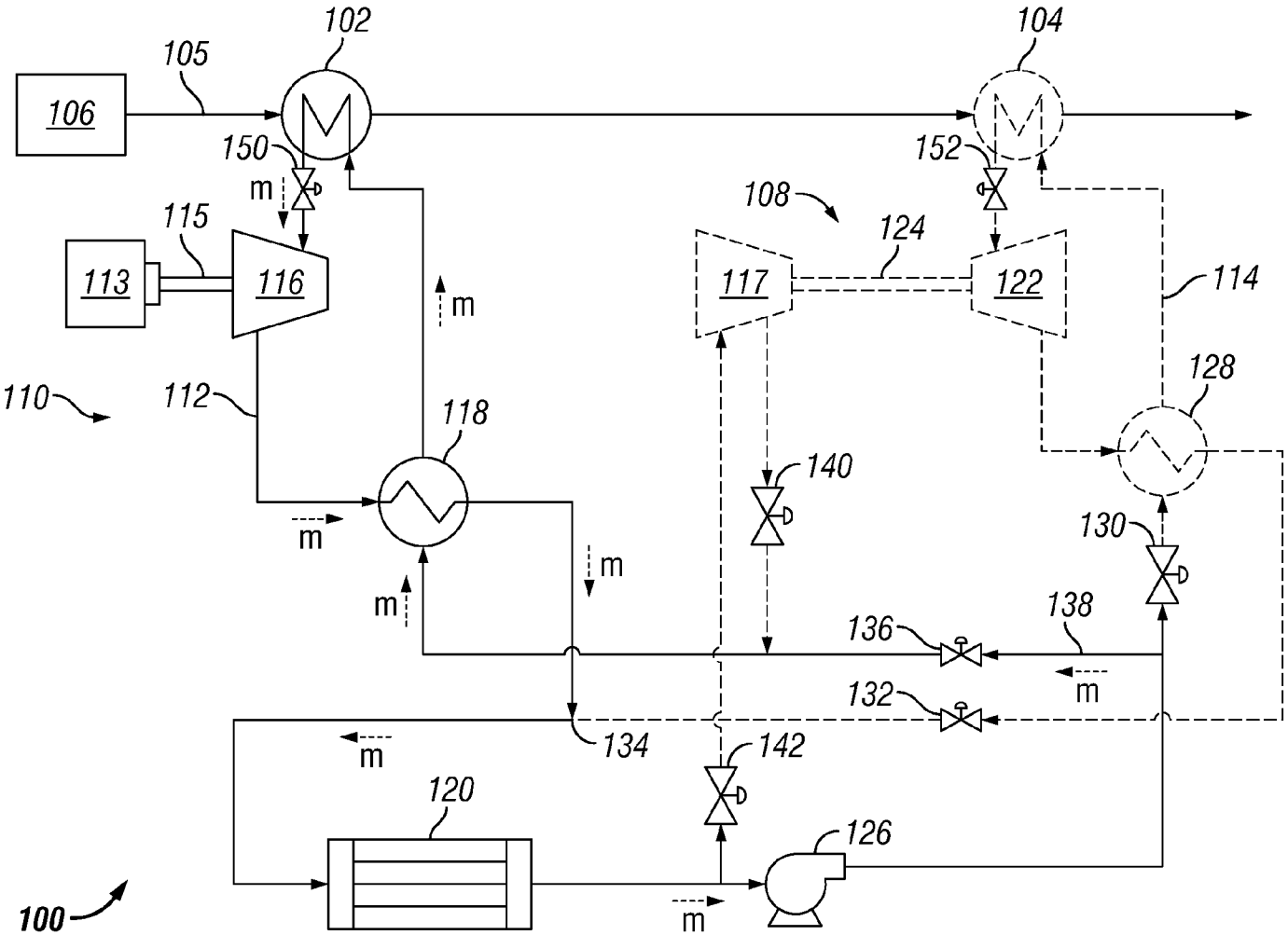
FIG. 2 schematically illustrates the heat engine of FIG. 1, operating in single-cycle mode, according to exemplary embodiments described herein.

Embodiments of the invention generally provide heat engine systems and methods for recovering energy (e.g., generating electricity) with such heat engine systems. FIGS. 1 and 2 schematically illustrate a heat engine system 100, according to an exemplary embodiment described herein. The heat engine system 100 is flexible and operates efficiently over a wide range of conditions of the heat source or stream (e.g., waste heat source or stream) from which the heat engine system 100 extracts energy. As will be discussed in further detail below, FIG. 1 illustrates the heat engine system 100 in dual-cycle mode, while FIG. 2 illustrates the heat engine system 100 in single-cycle mode. The dual-cycle mode may be particularly suitable for use with heat sources having temperatures greater than a predetermined threshold value, while the single-cycle mode may be particularly useful with heat sources having temperatures less than the threshold value. In some examples, the threshold value of the temperature of the heat source and/or the heat source stream is within a range from about 300° C. to about 400° C., such as about 350° C. Since the heat engine system 100 is capable of switching between the two modes of operation, for example, back-and-forth without limitation, the heat engine system 100 may operate at an increased efficiency over a broader range of heat source temperatures as compared to other heat engines. Although referred to herein as "dual-cycle" and "single-cycle" modes, it will be appreciated that the dual-cycle mode can include three or more cycles operating at once, and the single-cycle mode is intended to be indicative of a reduced number of active cycles, as compared to "dual-cycle" mode, but can include one or more cycles operating at once.

Referring now specifically to FIG. 1, the heat engine system 100 contains a first heat exchanger 102 and a second heat exchanger 104 fluidly coupled to and in thermal communication with a heat source stream 105, such as a waste heat stream. The heat source stream 105 may flow from or otherwise be derived from a heat source 106, such as a waste heat source or other source of thermal energy. In an exemplary embodiment, the first and second heat exchangers 102, 104 are coupled in series with respect to the heat source stream 105, such that the first heat exchanger 102 is disposed upstream of the second heat exchanger 104 along the heat source stream 105. Therefore, the first heat exchanger 102 generally receives the heat source stream 105 at a temperature greater than the temperature of the heat source stream 105 received by the second heat exchanger 104 since a portion of the thermal energy or heat was recovered by the first heat exchanger 102 prior to the heat source stream 105 flowing to the second heat exchanger 104.

The first and second heat exchangers 102, 104 may be or include one or more of suitable types of heat exchangers, for example, shell-and-tubes, plates, fins, printed circuits, combinations thereof, and/or any others, without limitation. Furthermore, it will be appreciated that additional heat exchangers may be employed and/or the first and second heat exchangers 102, 104 may be provided as different sections of a common heat exchanging unit. Since the first heat exchanger 102 may be exposed to the heat source stream 105 at greater temperatures, a greater amount of recovered thermal energy may be available for conversion to useful power by the expansion devices coupled to the first heat exchanger 102, relative to the recovered thermal energy available for conversion by the expansion devices coupled to the second heat exchanger 104.

The heat engine system 100 further contains a working fluid circuit 110, which is fluidly coupled to the first and second heat exchangers 102, 104. The working fluid circuit 110 may be configured to provide working fluid to and receive heated working fluid from one or both of the first and second heat exchangers 102, 104 as part of a first or "primary" circuit 112 and a second or "secondary" circuit 114. The primary and secondary circuits 112, 114 may thus enable collection of thermal energy from the heat source via the first and second heat exchangers 102, 104, for conversion into mechanical and/or electrical energy downstream.

The working fluid may be or contain carbon dioxide ($CO_2$) and mixtures containing carbon dioxide. Carbon dioxide as a working fluid for power generating cycles has many advantages as a working fluid, such as non-toxicity, non-flammability, easy availability, and relatively inexpensive. Due in part to its relatively high working pressure, a carbon dioxide system can be built that is much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

The working fluid circuit 110 contains the working fluid and has a high pressure side and a low pressure side. In exemplary embodiments, the working fluid contained in the working fluid circuit 110 is carbon dioxide or substantially contains carbon dioxide and may be in a supercritical state (e.g., sc-$CO_2$) and/or a subcritical state (e.g., sub-$CO_2$). In one example, the carbon dioxide working fluid contained within at least a portion of the high pressure side of the working fluid circuit 110 is in a supercritical state and the carbon dioxide working fluid contained within the low pressure side of the working fluid circuit 110 is in a subcritical state and/or supercritical state.

In other exemplary embodiments, the working fluid in the working fluid circuit 110 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of supercritical carbon dioxide (sc-$CO_2$), subcritical carbon dioxide (sub-$CO_2$), and/or one or more other miscible fluids or chemical compounds. In yet other exemplary embodiments, the working fluid may be a combination of carbon dioxide and propane, or carbon dioxide and ammonia, without departing from the scope of the disclosure.

The use of the term "working fluid" is not intended to limit the state or phase of matter of the working fluid or components of the working fluid. For instance, the working fluid or portions of the working fluid may be in a fluid phase, a gas phase, a supercritical state, a subcritical state, or any other phase or state at any one or more points within the heat engine system 100 or fluid cycle. The working fluid may be in a supercritical state over certain portions of the working fluid circuit 110 (e.g., the high pressure side), and in a subcritical state or a supercritical state over other portions of the working fluid circuit 110 (e.g., the low pressure side). In other exemplary embodiments, the entire working fluid circuit 110 may be operated and controlled such that the working fluid is in a supercritical or subcritical state during the entire execution of the working fluid circuit 110.

The heat source 106 and/or the heat source stream 105 may derive thermal energy from a variety of high-temperature sources. For example, the heat source stream 105 may be a waste heat stream such as, but not limited to, gas turbine exhaust, process stream exhaust, or other combustion product exhaust streams, such as furnace or boiler exhaust streams. Accordingly, the heat engine system 100 may be configured to transform waste heat or other thermal energy into electricity for applications ranging from bottom cycling in gas turbines, stationary diesel engine gensets, industrial waste heat recovery (e.g., in refineries and compression stations), and hybrid alternatives to the internal combustion engine. In other exemplary embodiments, the heat source 106 may derive thermal energy from renewable sources of thermal energy such as, but not limited to, a solar thermal source and a geothermal source. While the heat source 106 and/or the heat source stream 105 may be a fluid stream of the high temperature source itself, in other exemplary embodiments, the heat source 106 and/or the heat source stream 105 may be a thermal fluid in contact with the high temperature source. Thermal energy may be transferred from the thermal fluid to the first and second heat exchangers 102, 104, and further be transferred from the first and second heat exchangers 102, 104 to the working fluid in the working fluid circuit 110.

In various exemplary embodiments, the initial temperature of the heat source 106 and/or the heat source stream 105 entering the heat engine system 100 may be within a range from about 400° C. (about 752° F.) to about 650° C. (about 1,202° F.) or greater. However, the working fluid circuit 110 containing the working fluid (e.g., sc-$CO_2$) disclosed herein is flexible with respect to the temperature of the heat source stream and thus may be configured to efficiently extract energy from the heat source stream at lesser temperatures, for example, at a temperature of about 400° C. (about 752° F.) or less, such as about 350° C. (about 662° F.) or less, such as about 300° C. (about 572° F.) or less. Accordingly, the heat engine system 100 may include any sensors in or proximal to the heat source stream, for example, to determine the temperature, or another relevant condition (e.g., mass flow rate or pressure) of the heat source stream, to determine whether single or dual-cycle mode is more advantageous.

In an exemplary embodiment, the heat engine system 100 includes a power turbine 116, which may also be referred to as a first expander, as part of the primary circuit 112. The power turbine 116 is fluidly coupled to the first heat exchanger 102 via the primary circuit 112 and receives fluid from the first heat exchanger 102. The power turbine 116 may be any suitable type of expansion device, such as, for example, a single or multistage impulse or reaction turbine. Further, the power turbine 116 may be representative of multiple discrete turbines, which cooperate to expand the working fluid provided from the first heat exchanger 102, whether in series or in parallel. The power turbine 116 may be disposed between the high pressure side and the low pressure side of the working fluid circuit 110 and fluidly coupled to and in thermal communication with the working fluid. The power turbine 116 may be configured to convert thermal energy to mechanical energy by a pressure drop in the working fluid flowing between the high and the low pressure sides of the working fluid circuit 110.

The power turbine 116 is generally coupled to a generator 113 via a shaft 115, such that the power turbine 116 rotates the shaft 115 and the generator 113 converts such rotation into electricity. Therefore, the generator 113 may be configured to convert the mechanical energy from the power turbine 116 into electrical energy. Also, the generator 113 may be generally electrically coupled to an electrical grid (not shown) and configured to transfer the electrical energy to the electrical grid. It will be appreciated that speed-altering devices, such as gear boxes (not shown), may be employed in such a connection between or with the power turbine 116, the shaft 115, and/or the generator 113, or the power turbine 116 may be directly coupled to the generator 113.

The heat engine system 100 also contains a first recuperator 118, which is fluidly coupled to the power turbine 116 and receives working fluid therefrom, as part of the primary circuit 112. The first recuperator 118 may be any suitable heat exchanger or set of heat exchangers, and may serve to transfer heat remaining in the working fluid downstream of the power turbine 116 after expansion. For example, the first recuperator 118 may include one or more plate, fin, shell-and-tube, printed circuit, or other types of heat exchanger, whether in parallel or in series.

The heat engine system 100 also contains one or more condensers 120 fluidly coupled to the first recuperator 118 and configured to receive the working fluid therefrom. The condenser 120 may be, for example, a standard air or water-cooled condenser but may also be a trim cooler, adsorption chiller, mechanical chiller, a combination thereof, and/or the like. The condenser 120 may additionally or instead include one or more compressors, intercoolers, aftercoolers, or the like, which are configured to chill the working fluid, for example, in high ambient temperature regions and/or during summer months. Examples of systems that can be provided for use as the condenser 120 include the condensing systems disclosed in commonly assigned U.S. application Ser. No. 13/290,735, filed Nov. 7, 2011, and published as U.S. Pub. No. 2013/0113221, which is incorporated herein by reference in its entirety to the extent consistent with the present application.

The heat engine system 100 also contains a first pump 126 as part of the primary circuit 112 and/or the secondary circuit 114. The first pump 126 may a motor-driven pump or a turbine-driven pump and may be of any suitable design or size, may include multiple pumps, and may be configured to operate with a reduced flow rate and/or reduced pressure head as compared to a second pump 117. A reduced flow rate of the working fluid may be desired since less thermal energy may be available for extraction from the heat source stream during a startup process or a shutdown process. Furthermore, the first pump 126 may operate as a starter pump. Accordingly, during startup of the heat engine system 100, the first pump 126 may operate to power the drive turbine 122 to begin the operation of the second pump 117.

The first pump 126 may be fluidly coupled to the working fluid circuit 110 upstream of the first recuperator 118 and upstream of the second recuperator 128 to provide working fluid at increased pressure and/or flowrate. In one embodiment, the heat engine system 100 may be configured to utilize the first pump 126 as part of the primary circuit 112. The working fluid may be flowed from the first pump 126, through the third valve 136, through the high pressure side of the first recuperator 118, and then supplied back to the first heat exchanger 102, closing the loop on the primary circuit 112. In another embodiment, the heat engine system 100 may be configured to utilize the first pump 126 as part of the secondary circuit 114. The working fluid may be flowed from the first pump 126, through the first valve 130, through the high pressure side of the second recuperator 128, and then supplied back to the second heat exchanger 104, closing the loop on the secondary circuit 114.

Therefore, the primary circuit 112 may be configured to provide the working fluid to circulate in a cycle, whereby the working fluid exits the outlet of the first heat exchanger 102, flows through the power turbine throttle valve 150, flows through the power turbine 116, flows through the low pressure side (or cooling side) of the first recuperator 118, flows through point 134, flows through the condenser 120, flows through the first pump 126, flows through the third valve 136, flows through the high pressure side (or heating side) of the first recuperator 118, and enters the inlet of the first heat exchanger 102 to complete the cycle of the primary circuit 112.

In another exemplary embodiment described herein, when sufficient thermal energy is available from the heat source 106 and the heat source stream 105, the secondary circuit 114 may be active and configured to support the operation of the primary circuit 112, for example, by driving a turbopump, such as the second pump 117. To that end, the heat engine system 100 contains the drive turbine 122, which is fluidly coupled to the second heat exchanger 104 and may be configured to receive working fluid therefrom, as part of the secondary circuit 114. The drive turbine 122 may be any suitable axial or radial, single or multistage, impulse or reaction turbine, or any such turbines acting in series or in parallel. Further, the drive turbine 122 may be mechanically linked to a turbopump, such as the second pump 117 via a shaft 124, for example, such that the rotation of the drive turbine 122 causes rotation of the second pump 117. In some exemplary embodiments, the drive turbine 122 may additionally or instead drive other components of the heat engine system 100 or other systems (not shown), may power a generator, and/or may be electrically coupled to one or more motors configured to drive any other device.

The heat engine system 100 may also include a second recuperator 128, as part of the secondary circuit 114, which is fluidly coupled to the drive turbine 122 and configured to receive working fluid therefrom in the secondary circuit 114. The second recuperator 128 may be any suitable heat exchanger or set of heat exchangers, and may serve to transfer heat remaining in the working fluid downstream of the drive turbine 122 after expansion. For example, the second recuperator 128 may include one or more plates, fins, shell-and-tubes, printed circuits, or other types of heat exchanger, whether in parallel or in series.

The second recuperator 128 may be fluidly coupled with the condenser 120 via the working fluid circuit 110. The low pressure side or cooling side of the second recuperator 128 may be fluidly coupled downstream of the drive turbine 122 and upstream of the condenser 120. The high pressure side or heating side of the second recuperator 128 may be fluidly coupled downstream of the first pump 126 and upstream of the second heat exchanger 104. Accordingly, the condenser 120 may receive a combined flow of working fluid from both the first and second recuperators 118, 128. In another exemplary embodiment, the condenser 120 may receive separate flows from the first and second recuperators 118, 128 and may mix the flows in the condenser 120. In other exemplary embodiments, the condenser 120 may be representative of two condensers, which may maintain the flows as separate streams, without departing from the scope of the disclosure. In the illustrated exemplary embodiment, the primary and secondary circuits 112, 114 may be described as being "overlapping" with respect to the condenser 120, as the condenser 120 is part of both the primary and secondary circuits 112, 114.

The heat engine system 100 further includes a second pump 117 as part of the secondary circuit 114 during dual-cycle mode of operation. The second pump 117 may be fluidly coupled to and disposed downstream of the condenser 120 on the low pressure side of the working fluid circuit 110, such that the outlet of the condenser 120 is upstream of the inlet of the second pump 117. Also, the second pump 117 may be fluidly coupled to and disposed upstream of the first recuperator 118 on the high pressure side of the working fluid circuit 110, such that the inlet of the first recuperator 118 is upstream of the outlet of the second pump 117.

The second pump 117 may be configured to receive at least a portion of the working fluid condensed in the condenser 120, as part of the secondary circuit 114 during the dual-cycle mode of operation. The second pump 117 may be any suitable turbopump or a component of a turbopump, such as a centrifugal turbopump, which is suitable to pressurize the working fluid, for example, in liquid form, at a desired flow rate to a desired pressure. In one or more embodiments, the second pump 117 may be a turbopump and may be powered by an expander or turbine, such as a drive turbine 122. In one specific exemplary embodiment, the second pump 117 may be a component of a turbopump unit 108 and coupled to the drive turbine 122 by the shaft 124, as depicted in FIGS. 1 and 2. However, in other embodiments, the second pump 117 may be at least partially driven by the power turbine 116 (not shown). In an alternative embodiment, instead of being coupled to and driven by the drive turbine 122 or another turbine, the second pump 117 may be coupled to and driven by an electric motor, a gas or diesel engine, or any other suitable device.

Therefore, the secondary circuit 114 provides the working fluid to circulate in a cycle, whereby the working fluid exits the outlet of the second heat exchanger 104, flows through the turbo pump throttle valve 152, flows through the drive turbine 122, flows through the low pressure side (or cooling side) of the second recuperator 128, flows through the second valve 132, flows through the condenser 120, flows through the fifth valve 142, flows through the second pump 117, flows through the fourth valve 140, and then is discharged into the primary circuit 112 at the point 134 on the working fluid circuit 110 downstream of the third valve 136 and upstream of the high pressure side of the first recuperator 118. From the primary circuit 112, upon setting the third valve 136 and the fifth valve 142 in closed-positions and the first valve 130 in an opened-position, the secondary circuit 114 further provides that the working fluid flows through the first pump 126, flows through the first valve 130, flows through the high pressure side of the second recuperator 128, and then supplied back to the second heat exchanger 104, closing the loop on the secondary circuit 114.

The heat engine system 100 contains a variety of components fluidly coupled to the working fluid circuit 110, as depicted in FIGS. 1 and 2. The working fluid circuit 110 contains high and low pressure sides during actual operation of the heat engine system 100. Generally, the portions of the high pressure side of the working fluid circuit 110 are disposed downstream of the pumps, such as the first pump 126 and the second pump 117, and upstream of the turbines, such as the power turbine 116 and the drive turbine 122. Inversely, the portions of the low pressure side of the working fluid circuit 110 are disposed downstream of the turbines, such as the power turbine 116 and the drive turbine 122, and upstream of the pumps, such as the first pump 126 and the second pump 117.

In an exemplary embodiment, a first portion of the high pressure side of the working fluid circuit 110 may extend from the first pump 126, through the first valve 130, through the second recuperator 128, through the second heat exchanger 104, through the turbo pump throttle valve 152, and into the drive turbine 122. In another exemplary embodiment, a second portion of the high pressure side of the working fluid circuit 110 may extend from the second pump 117, through the fourth valve 140, through the first recuperator 118, through the first heat exchanger 102, through the power turbine throttle valve 150, and into the power turbine 116. In another exemplary embodiment, a first portion of the low pressure side of the working fluid circuit 110 may extend from the drive turbine 122, through the second recuperator 128, through the second valve 132, through the condenser 120, and either into the first pump 126 and/or through the fifth valve 142, and into the second pump 117. In another exemplary embodiment, a second portion of the low pressure side of the working fluid circuit 110 may extend from the power turbine 116, through the first recuperator 118, through the condenser 120, and either into the first pump 126 and/or through the fifth valve 142, and into the second pump 117.

Some components of the heat engine system 100 may be fluidly coupled to both the high and low pressure sides, such as the turbines, the pumps, and the recuperators. Therefore, the low pressure side or the high pressure side of a particular component refers to the respective low or high pressure side of the working fluid circuit 110 fluidly coupled to the component. For example, the low pressure side (or cooling side) of the second recuperator 128 refers to the inlet and the outlet on the second recuperator 128 fluidly coupled to the low pressure side of the working fluid circuit 110. In another example, the high pressure side of the power turbine 116 refers to the inlet on the power turbine 116 fluidly coupled to the high pressure side of the working fluid circuit 110 and the low pressure side of the power turbine 116 refers to the outlet on the power turbine 116 fluidly coupled to the low pressure side of the working fluid circuit 110.

The heat engine system 100 also contains a plurality of valves operable to control the mode of operation of the heat engine system 100. The plurality of valves may include five or more valves. For example, the heat engine system 100 contains a first valve 130, a second valve 132, a third valve 136, a fourth valve 140, and a fifth valve 142. In an exemplary embodiment, the first valve 130 may be operatively coupled to the high pressure side of the working fluid circuit 110 and may be disposed downstream of the first pump 126 and upstream of the second recuperator 128. The second valve 132 may be operatively coupled to the low pressure side of the working fluid circuit 110 in the secondary circuit 114 and may be disposed downstream of the second recuperator 128 and upstream of the condenser 120. Further, in embodiments of the heat engine system 100 in which the primary and secondary circuits 112, 114 overlap to share the condenser 120, the second valve 132 may be disposed upstream of the point 134 where the primary and secondary circuits 112, 114 combine, mix, or otherwise come together upstream of the condenser 120. The third valve 136 may be operatively coupled to the high pressure side of the working fluid circuit 110 and may be disposed downstream of the first pump 126 and upstream of the first recuperator 118. The fourth valve 140 may be operatively coupled to the high pressure side of the working fluid circuit 110 and may be disposed downstream of the second pump 117 and upstream of the first recuperator 118. The fifth valve 142 may be operatively coupled to the low pressure side of the working fluid circuit 110 and may be disposed downstream of the condenser 120 and upstream of the second pump 117.

FIG. 1 illustrates a dual-cycle mode of operation, according to an exemplary embodiment of the heat engine system 100. In dual-cycle mode, both the primary and secondary circuits 112, 114 are active, with a first mass flow "$m_1$" of working fluid coursing through the primary circuit 112, a second mass flow "$m_2$" of working fluid coursing through the secondary circuit 114, and a combined flow "$m_1+m_2$" thereof coursing through overlapping sections of the primary and secondary circuits 112, 114, as indicated.

During the dual-cycle mode of operation, in the primary circuit 112, the first mass flow $m_1$ of the working fluid recovers energy from the higher-grade heat coursing through the first heat exchanger 102. This heat recovery transitions the first mass flow $m_1$ of the working fluid from an intermediate-temperature, high-pressure working fluid provided to the first heat exchanger 102 during steady-state operation to a high-temperature, high-pressure first mass flow $m_1$ of the working fluid exiting the first heat exchanger 102. In an exemplary embodiment, the working fluid may be at least partially in a supercritical state when exiting the first heat exchanger 102.

The high-temperature, high-pressure (e.g., supercritical state/phase) first mass flow $m_1$ is directed in the primary circuit 112 from the first heat exchanger 102 to the power turbine 116. At least a portion of the thermal energy stored in the high-temperature, high-pressure first mass flow $m_1$ is converted to mechanical energy in the power turbine 116 by expansion of the working fluid. In some examples, the power turbine 116 and the generator 113 may be coupled together and the generator 113 may be configured to convert the mechanical energy into electrical energy, which can be used to power other equipment, provided to a grid, a bus, or the like. In the power turbine 116, the pressure, and, to a certain extent, the temperature of the first mass flow $m_1$ of the working fluid is reduced; however, the temperature still remains generally in a high temperature range of the primary circuit 112. Accordingly, the first mass flow $m_1$ of the working fluid exiting the power turbine 116 is a low-pressure, high-temperature working fluid. The low-pressure, high-temperature first mass flow $m_1$ of the working fluid may be at least partially in gas phase.

The low-pressure, high-temperature first mass flow $m_1$ of the working fluid is then directed to the first recuperator 118. The first recuperator 118 is coupled to the primary circuit 112 downstream of the power turbine 116 on the low-pressure side and upstream of the first heat exchanger 102 on the high-pressure side. Accordingly, a portion of the heat remaining in the first mass flow $m_1$ of the working fluid exiting from the power turbine 116 is transferred to a low-temperature, high-pressure first mass flow $m_1$ of the working fluid, upstream of the first heat exchanger 102. As such, the first recuperator 118 acts as a pre-heater for the first mass flow $m_1$ proceeding to the first heat exchanger 102, thereby providing the intermediate temperature, high-pressure first mass flow $m_1$ of the working fluid thereto. Further, the first recuperator 118 acts as a pre-cooler for the first mass flow $m_1$ of the working fluid proceeding to the condenser 120, thereby providing an intermediate-temperature, low-pressure first mass flow $m_1$ of the working fluid thereto.

Upstream of or within the condenser 120, the intermediate-temperature, low-pressure first mass flow $m_1$ may be combined with an intermediate-temperature, low-pressure second mass flow $m_2$ of the working fluid. However, whether combined or not, the first mass flow $m_1$ may proceed to the condenser 120 for further cooling and, for example, at least partial phase change to a liquid. In an exemplary embodiment, the combined mass flow $m_1+m_2$ of the working fluid is directed to the condenser 120, and subsequently split back into the two mass flows $m_1$, $m_2$ as the working fluid is directed to the discrete portions of the primary and secondary circuits 112, 114.

The condenser 120 reduces the temperature of the working fluid, resulting in a low-pressure, low-temperature working fluid, which may be at least partially condensed into liquid phase. In dual-cycle mode, the first mass flow $m_1$ of the low-pressure, low-temperature working fluid is split from the combined mass flow $m_1+m_2$ and passed from the condenser 120 to the second pump 117 for pressurization. The second pump 117 may add a nominal amount of heat to the first mass flow $m_1$ of the working fluid, but is provided primarily to increase the pressure thereof. Accordingly, the first mass flow $m_1$ of the working fluid exiting the second pump 117 is a high-pressure, low-temperature working fluid. The first mass flow $m_1$ of the working fluid is then directed to the first recuperator 118, for heat transfer with the high-temperature, low-pressure first mass flow $m_1$ of the working fluid, downstream of the power turbine 116. The first mass flow $m_1$ of the working fluid exiting the first recuperator 118 as an intermediate-temperature, high-pressure first mass flow $m_1$ of the working fluid, and is directed to the first heat exchanger 102, thereby closing the loop of the primary circuit 112.

During dual-cycle mode, as shown in FIG. 1, the second mass flow $m_2$ of combined flow $m_1+m_2$ working fluid from the condenser 120 is split off and directed into the secondary circuit 114. The second mass flow $m_2$ may be directed to the first pump 126, for example. The first pump 126 may heat the fluid to a certain extent; however, the primary purpose of the first pump 126 is to pressurize the working fluid. Accordingly, the second mass flow $m_2$ of the working fluid exiting the first pump 126 is a low-temperature, high-pressure second mass flow $m_2$ of the working fluid.

The low-temperature, high-pressure second mass flow $m_2$ of the working fluid is then routed to the second recuperator 128 for preheating. The second recuperator 128 is coupled to the secondary circuit 114 downstream of the first pump 126 on the high-pressure side, upstream of the second heat exchanger 104 on the high-pressure side, and downstream of the drive turbine 122 on the low-pressure side. The second mass flow $m_2$ of the working fluid from the first pump 126 is preheated in the recuperator 128 to provide an intermediate-temperature, high-pressure second mass flow $m_2$ of the working fluid to the second heat exchanger 104.

The second mass flow $m_2$ of the working fluid in the second heat exchanger 104 is heated to provide a high-temperature, high-pressure second mass flow $m_2$ of the working fluid. In an exemplary embodiment, the second mass flow $m_2$ of the working fluid exiting the second heat exchanger 104 may be in a supercritical state. The high-temperature, high-pressure second mass flow $m_2$ of the working fluid may then be directed to the drive turbine 122 for expansion to drive the second pump 117, for example, thus closing the loop on the secondary circuit 114.

During dual-cycle mode, the first, second, fourth, and fifth valves 130, 132, 140, 142 may be open (each valve in an opened-position), while the third valve 136 may be closed (valve in a closed-position), as shown in an exemplary embodiment. As indicated by the solid lines depicting fluid conduits therebetween, the first, second, fourth, and fifth valves 130, 132, 140, 142—in opened-positions—allow fluid communication therethrough. As such, the first pump 126 is in fluid communication with the second recuperator 128 via the first valve 130, and the second recuperator 128 is in fluid communication with the condenser 120 via the second valve 132. Further, the second pump 117 is in fluid communication with the first recuperator 118 via the fourth valve 140, and the condenser 120 is in fluid communication with the second pump 117 via the fifth valve 142. In contrast, as depicted by the dashed line for conduit 138, although they are fluidly coupled as the term is used herein, fluid communication between the first pump 126 and the first recuperator 118 is generally prohibited by the third valve 136 in a closed-position.

Such configuration of the valves 130, 132, 136, 140, 142 maintains the separation of the discrete portions of the primary and secondary circuits 112, 114 upstream and downstream of, for example, the condenser 120. Accordingly, the secondary circuit 114 may be operable to recover thermal energy from the heat source stream 105 in the second heat exchanger 104 and employ such thermal energy to, for example, power the drive turbine 122, which drives the second pump 117 of the primary circuit 112. The primary circuit 112, in turn, may recover a greater amount of thermal energy from the heat source stream 105 in the first heat exchanger 102, as compared to the thermal energy recovered by the secondary circuit 114 in the second heat exchanger 104, and may convert the thermal energy into shaft rotation and/or electricity as an end-product for the heat engine system 100.

FIG. 2 schematically depicts the heat engine system 100 of FIG. 1, but with the opened/closed-positions of the valves 130, 132, 136, 140, 142 being changed to provide the single-cycle mode of operation for the heat engine system 100, according to an exemplary embodiment. In the single-cycle mode of operation, the heat engine system 100 may be utilized with less or a reduced number of active components and conduits of the working fluid circuit 110 than in the dual-cycle mode of operation. Active components and conduits contain the working fluid flowing or otherwise passing therethrough during normal operation of the heat engine system 100. Inactive components and conduits have a reduced flow or lack flow of the working fluid passing therethrough during normal operation of the heat engine system 100. The inactive components and conduits are indicated in FIG. 2 by dashed lines, according to one exemplary embodiment among many contemplated. More particularly, the flow of the working fluid to the second heat exchanger 104 may be substantially cut-off in the single-cycle mode, thereby de-activating the second heat exchanger 104. The flow of the working fluid to the second heat exchanger 104 may be initially cut-off due to reduced temperature of the heat source stream 105 from the heat source 106, component failure, or for other reasons. In one configuration, the heat engine system 100 may include a sensor (not shown) which may monitor the temperature of the heat source stream 105, for example, as the heat source stream 105 enters the first heat exchanger 102. Once the sensor reads or otherwise measures a temperature of less than a threshold value, for example, the heat engine system 100 may be switched, either manually or automatically with a programmable controller, to operate in single-cycle mode. Once the temperature becomes equal to or greater than the threshold value, the heat engine system 100 may be switched back to the dual-cycle mode. In some embodiments, the threshold value of the temperature of the heat source and/or the heat source stream 105 may be within a range from about 300° C. (about 572° F.) to about 400° C. (about 752° F.), more narrowly within a range from about 320° C. (about 608° F.) to about 380° C. (about 716° F.), and more narrowly within a range from about 340° C. (about 644° F.) to about 360° C. (about 680° F.), for example, about 350° C. (about 662° F.).

As indicated, the first heat exchanger 102 may be active, while the second heat exchanger 104 is inactive or de-activated. Thus, splitting of the combined flow of the working fluid to feed both heat exchangers 102, 104, described herein for the dual-cycle mode of operation, may no longer be required and a single mass flow "m" of the working fluid to the first heat exchanger 102 may develop. Additionally, flow of the working fluid to the drive turbine 122 and the second recuperator 128 may also be cut-off or stopped, as the working fluid flows may be provided to recover thermal energy via the second heat exchanger 104, as discussed above, which is now inactive.

Since the drive turbine 122, powered by thermal energy recovered in the second heat exchanger 104 during the dual-cycle mode of operation, is also inactive or deactivated during the single-cycle mode of operation, the second pump 117 may lack a driver. Accordingly, the second pump 117 may be isolated and deactivated via closure of the fourth and fifth valves 140, 142. However, as is known for thermodynamic cycles, the working fluid in the active primary circuit 112 requires pressurization, which, in the single-cycle mode of operation, may be provided by the first pump 126. By closure of the fifth valve 142 and opening of the third valve 136, the working fluid is directed from the condenser 120 and to the first pump 126 for pressurization. Thereafter, the working fluid proceeds to the first recuperator 118 and then to the first heat exchanger 102.

Although described as two-way control valves, it will be appreciated that the valves 130, 132, 136, 140, 142 may be provided by any suitable type of valve. For example, the second and fourth valves 132, 140 may function to stop back-flow into inactive portions of the heat engine system 100. More particularly, in an exemplary embodiment, the fifth valve 142 prevents fluid from flowing through the second pump 117 and to the fourth valve 140, while the first valve 130 prevents fluid from flowing through the second recuperator 128, second heat exchanger 104, and drive turbine 122 to the second valve 132. The function of the second and fourth valves 132, 140, thus, is to prevent reverse flow into the inactive components. As such, the second and fourth valves 132, 140 may be one-way check valves. Furthermore, in another configuration, the first and third valves 130, 136, for example, may be combined and replaced with a three-way valve, without departing from the scope of the disclosure. Since a single three-way valve may effectively provide the function of two two-way valves, reference to the first and third valves 130, 136 together is to be construed to literally include a single three-way valve, or a valve with greater than three ways (e.g., four-way), that provides the function described herein.

The heat engine system 100 further contains a power turbine throttle valve 150 fluidly coupled to the working fluid circuit 110 upstream of the inlet of the power turbine 116 and downstream of the outlet of the first heat exchanger 102. The power turbine throttle valve 150 may be configured to modulate, adjust, or otherwise control the flowrate of the working fluid passing into the power turbine 116, thereby providing control of the power turbine 116 and the amount of work energy produced by the power turbine 116. Also, the heat engine system 100 further contains a turbo pump throttle valve 152 fluidly coupled to the working fluid circuit 110 upstream of the inlet of the drive turbine 122 of the turbopump unit 108 and downstream of the outlet of the second heat exchanger 104. The turbo pump throttle valve 152 may be configured to modulate, adjust, or otherwise control the flowrate of the working fluid passing into the drive turbine 122, thereby providing control of the drive turbine 122 and the amount of work energy produced by the drive turbine 122. The power turbine throttle valve 150 and the turbo pump throttle valve 152 may be independently controlled by the process control system (not shown) that is communicably connected, wired and/or wirelessly, with the power turbine throttle valve 150, the turbo pump throttle valve 152, and other components and parts of the heat engine system 100.

Figure 3:
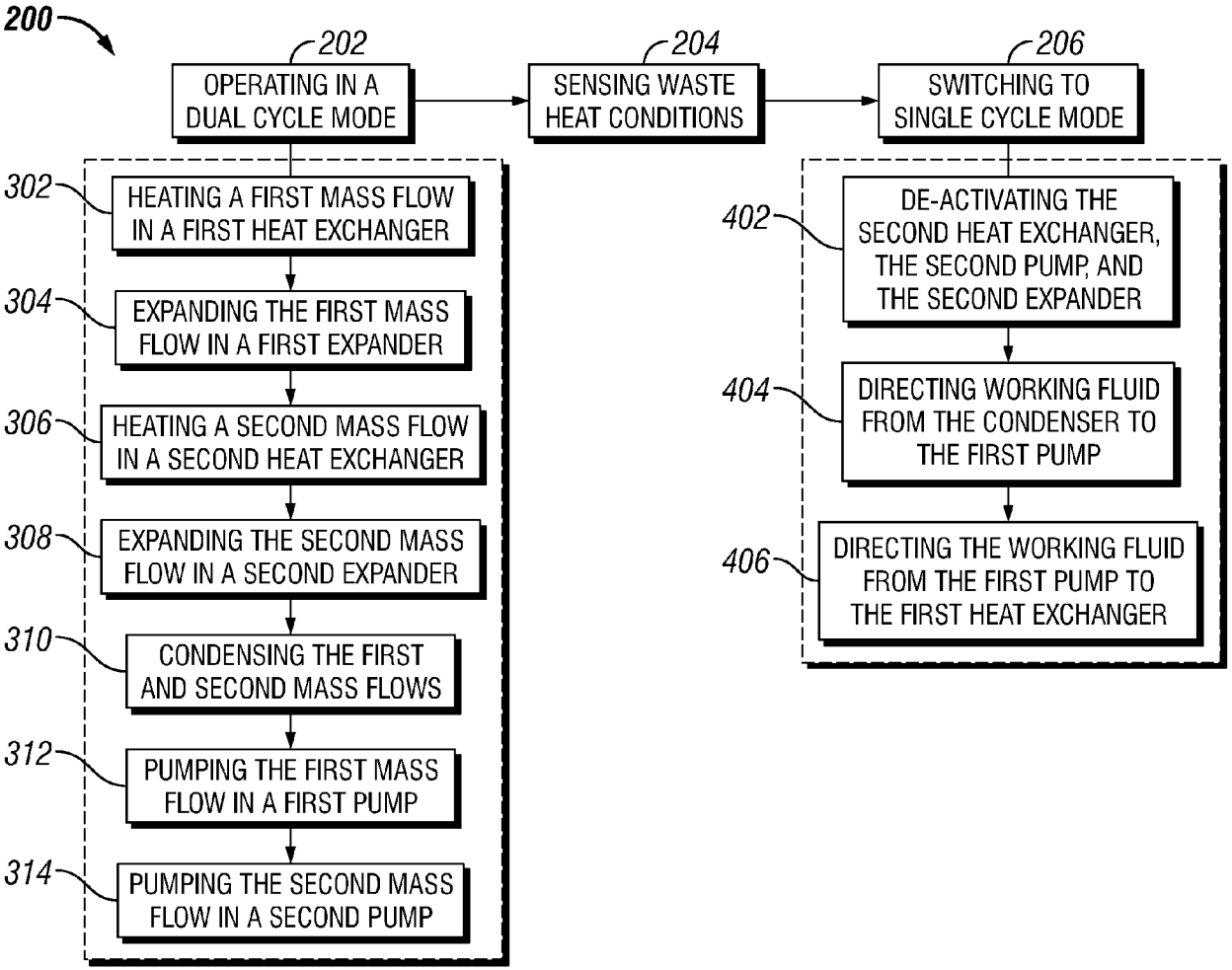
FIG. 3 illustrates a flowchart of a method for extracting energy from heat source, according to exemplary embodiments described herein.

FIG. 3 illustrates a flowchart of a method 200 for extracting energy from heat source stream. The method 200 may proceed by operation of one or more embodiments of the heat engine system 100, as described herein with reference to FIGS. 1 and/or 2 and may thus be best understood with continued reference thereto. The method 200 may include operating a heat engine system in a dual-cycle mode, as at 202. The method 200 may further include sensing the temperature or another condition of heat source stream fed to the system, as at 204, for example, as the heat source stream is fed into a first heat exchanger, which is thermally coupled to the heat source (e.g., waste heat source or stream). This may occur prior to, during, or after initiation of operation of the dual-cycle mode at 202. If the temperature of the heat source stream is less than a threshold value, the method 200 may switch the system to operate in a single-cycle mode, as at 206. In some examples, the threshold value of the temperature may be within a range from about 300° C. to about 400° C., more narrowly within a range from about 320° C. to about 380° C., and more narrowly within a range from about 340° C. to about 360° C., such as about 350° C. The sensing at 204 may be iterative, may be polled on a time delay, may operate on an alarm, trigger, or interrupt basis to alert a controller coupled to the system, or may simply result in a display to an operator, who may then toggle the system to the appropriate operating cycle.

Operating the heat engine system in dual-cycle mode, as at 202, may include heating a first mass flow of working fluid in the first heat exchanger thermally coupled to a heat source, as at 302. Operating at 202 may also include expanding the first mass flow in a first expander, as at 304. Operating at 202 may also include heating a second mass flow of working fluid in a second heat exchanger thermally coupled to the heat source, as at 306. Operating at 202 may further include expanding the second mass flow in a second expander, as at 308. Additionally, operating at 202 may include at least partially condensing the first and second mass flows in one or more condensers, as at 310. Operating at 202 may include pressurizing the first mass flow in a first pump, as at 312. Operating at 202 may also include pressurizing the second mass flow in a second pump, as at 314.

In an exemplary embodiment, operating at 202 may include transferring heat from the first mass flow downstream of the first expander and upstream of the condenser to the first mass flow downstream of the first pump and upstream of the first heat exchanger. Further, operating at 202 may also include transferring heat from the second mass flow downstream of the second expander and upstream of the condenser to the second mass flow downstream of the second pump and upstream of the second heat exchanger.

Switching at 204 may include de-activating the second heat exchanger, the second expander, and the first pump, as at 402. Switching at 204 may also include directing the working fluid from the condenser to the second pump, as at 404. Switching at 204 may also include directing the working fluid from the first pump to the first heat exchanger, as at 406. In embodiments including first and second recuperators, switching at 204 may also include de-activating the second recuperator and directing the working fluid from the second pump to the first recuperator.

Exemplary Embodiments

In one or more exemplary embodiments disclosed herein, as depicted in FIGS. 1 and 2, a heat engine system 100 contains a working fluid within a working fluid circuit 110 having a high pressure side and a low pressure side. The working fluid generally contains carbon dioxide and at least a portion of the working fluid circuit 110 contains the working fluid in a supercritical state. The heat engine system 100 further contains a first heat exchanger 102 and a second heat exchanger 104, such that each of the first and second heat exchangers 102, 104 may be fluidly coupled to and in thermal communication with the high pressure side of the working fluid circuit 110, configured to be fluidly coupled to and in thermal communication with a heat source stream 105 (e.g., a waste heat stream), and configured to transfer thermal energy from the heat source stream 105 to the working fluid within the working fluid circuit 110. The heat source stream 105 may flow from or otherwise be derived from a heat source 106, such as a waste heat source or other source of thermal energy. The heat engine system 100 also contains a first expander, such as a power turbine 116, fluidly coupled to and disposed downstream of the first heat exchanger 102 on the high pressure side of the working fluid circuit 110 and a second expander, such as a drive turbine 122, fluidly coupled to and disposed downstream of the second heat exchanger 104 on the high pressure side of the working fluid circuit 110.

The heat engine system 100 further contains a first recuperator 118 and a second recuperator 128 fluidly coupled to the working fluid circuit 110. The first recuperator 118 may be fluidly coupled to and disposed downstream of the power turbine 116 on the low pressure side of the working fluid circuit 110 and fluidly coupled to and disposed upstream of the first heat exchanger 102 on the high pressure side of the working fluid circuit 110. In some embodiments, the first recuperator 118 may be configured to transfer thermal energy from the working fluid received from the power turbine 116 to the working fluid received from the first and second pumps 126, 117 when the heat engine system 100 is in the dual-cycle mode. The second recuperator 128 may be fluidly coupled to and disposed downstream of the drive turbine 122 on the low pressure side of the working fluid circuit 110 and fluidly coupled to and disposed upstream of the second heat exchanger 104 on the high pressure side of the working fluid circuit 110. In some embodiments, the second recuperator 128 may be configured to transfer thermal energy from the working fluid received from the drive turbine 122 to the working fluid received from the first pump 126 when the heat engine system 100 is in dual-cycle mode and is inactive when the heat engine system 100 is in the single-cycle mode.

The heat engine system 100 further contains a condenser 120, a first pump 126, and a second pump 117 fluidly coupled to the working fluid circuit 110. The condenser 120 may be fluidly coupled to and disposed downstream of the first recuperator 118 and the second recuperator 128 on the low pressure side of the working fluid circuit 110. The condenser 120 may be configured to remove thermal energy from the working fluid passing through the low pressure side of the working fluid circuit 110. The condenser 120 may also be configured to control or regulate the temperature of the working fluid circulating through the working fluid circuit 110. The first pump 126 may be fluidly coupled to and disposed downstream of the condenser 120 on the low pressure side of the working fluid circuit 110 and fluidly coupled to and disposed upstream of the first recuperator 118 and the second recuperator 128 on the high pressure side of the working fluid circuit 110. The second pump 117 may be fluidly coupled to and disposed downstream of the condenser 120 on the low pressure side of the working fluid circuit 110 and fluidly coupled to and disposed upstream of the first recuperator 118 on the high pressure side of the working fluid circuit 110. In some exemplary embodiments, the second pump 117 may be a turbopump, the second expander may be the drive turbine 122, and the drive turbine 122 may be coupled to the turbopump and operable to drive the turbopump when the heat engine system 100 is in the dual-cycle mode.

In some exemplary embodiments, the heat engine system 100 further contains a plurality of valves operatively coupled to the working fluid circuit 110 and configured to switch the heat engine system 100 between a dual-cycle mode and a single-cycle mode. In the dual-cycle mode, the first and second heat exchangers 102, 104 and the first and second pumps 126, 117 are active as the working fluid is circulated throughout the working fluid circuit 110. However, in the single-cycle mode, the first heat exchanger 102 and the power turbine 116 are active and at least the second heat exchanger 104 and the second pump 117 are inactive as the working fluid is circulated throughout the working fluid circuit 110.

In other exemplary embodiments, the plurality of valves may include five or more valves operatively coupled to the working fluid circuit 110 for controlling the flow of the working fluid. A first valve 130 may be operatively coupled to the high pressure side of the working fluid circuit 110 and disposed downstream of the first pump 126 and upstream of the second recuperator 128. A second valve 132 may be operatively coupled to the low pressure side of the working fluid circuit 110 and disposed downstream of the second recuperator 128 and upstream of the condenser 120. A third valve 136 may be operatively coupled to the high pressure side of the working fluid circuit 110 and disposed downstream of the first pump 126 and upstream of the first recuperator 118. A fourth valve 140 may be operatively coupled to the high pressure side of the working fluid circuit 110 and disposed downstream of the second pump 117 and upstream of the first recuperator 118. A fifth valve 142 may be operatively coupled to the low pressure side of the working fluid circuit 110 and disposed downstream of the condenser 120 and upstream of the second pump 117.

In some examples, the plurality of valves may include a valve, such as the fourth valve 140, disposed between the condenser 120 and the second pump 117, wherein the fourth valve 140 is closed when the heat engine system 100 is in the single-cycle mode and the fourth valve 140 is open when the heat engine system 100 is in the dual-cycle mode. In other examples, the plurality of valves may include a valve, such as the third valve 136, disposed between the first pump 126 and the first recuperator 118, the third valve 136 may be configured to prohibit flow of the working fluid from the first pump 126 to the first recuperator 118 when the heat engine system 100 is in the dual-cycle mode and to allow fluid flow therebetween when the heat engine system 100 is in the single-cycle mode.

In some examples, the working fluid from the low pressure side of the first recuperator 118 and the working fluid from the low pressure side of the second recuperator 128 combine at a point 134 on the low pressure side of the working fluid circuit 110, such that the point 134 may be disposed upstream of the condenser 120 and downstream of the second valve 132. In some configurations, each of the first, second, fourth, and fifth valves 130, 132, 140, 142 may be in an opened-position and the third valve 136 may be in a closed-position when the heat engine system 100 is in the dual-cycle mode. Alternatively, when the heat engine system 100 is in the single-cycle mode, each of the first, second, fourth, and fifth valves 130, 132, 140, 142 may be in a closed-position and the third valve 136 may be in an opened-position.

In other embodiments disclosed herein, the plurality of valves may be configured to actuate in response to a change in temperature of the heat source stream 105. For example, when the temperature of the heat source stream 105 becomes less than a threshold value, the plurality of valves may be configured to switch the heat engine system 100 to the single-cycle mode. Also, when the temperature of the heat source stream 105 becomes equal to or greater than the threshold value, the plurality of valves may be configured to switch the heat engine system 100 to the dual-cycle mode. In some examples, the threshold value of the temperature of the heat source stream 105 is within a range from about 300° C. to about 400° C., such as about 350° C.

In other embodiments disclosed herein, the plurality of valves may be configured to switch the heat engine system 100 between the dual-cycle mode and the single-cycle mode, such that in the dual-cycle mode, the plurality of valves may be configured to direct the working fluid from the condenser 120 to the first and second pumps 126, 117, and subsequently, direct the working fluid from the first pump 126 to the second heat exchanger 104 and/or direct the working fluid from the second pump 117 to the first heat exchanger 102. In the single-cycle mode, the plurality of valves may be configured to direct the working fluid from the condenser 120 to the first pump 126 and from the first pump 126 to the first heat exchanger 102, and to substantially cut-off or stop the flow of the working fluid to the second pump 117, the second heat exchanger 104, and the drive turbine 122.

In one or more embodiments disclosed herein, a method for recovering energy from a heat source (e.g., waste heat source) is provided and includes operating a heat engine system 100 in a dual-cycle mode and subsequently switching the heat engine system 100 from the dual-cycle mode to a single-cycle mode. In the dual-cycle mode, the method includes operating the heat engine system 100 by heating a first mass flow of a working fluid in the first heat exchanger 102 fluidly coupled to and in thermal communication with a working fluid circuit 110 and a heat source stream 105 and expanding the first mass flow in a power turbine 116 fluidly coupled to the first heat exchanger 102 via the working fluid circuit 110. The first heat exchanger 102 may be configured to transfer thermal energy from the heat source stream 105 to the first mass flow of the working fluid within the working fluid circuit 110. In many exemplary embodiments, the working fluid contains carbon dioxide and at least a portion of the working fluid circuit 110 contains the working fluid in a supercritical state.

Also, in the dual-cycle mode, the method includes heating a second mass flow of the working fluid in the second heat exchanger 104 fluidly coupled to and in thermal communication with the working fluid circuit 110 and the heat source stream 105 and expanding the second mass flow in a second expander, such as the drive turbine 122, fluidly coupled to the second heat exchanger 104 via the working fluid circuit 110. The second heat exchanger 104 may be configured to transfer thermal energy from the heat source stream 105 to the second mass flow of the working fluid within the working fluid circuit 110. The method further includes, in the dual-cycle mode, at least partially condensing the first and second mass flows in one or more condensers, such as the condenser 120, fluidly coupled to the working fluid circuit 110, pressurizing the first mass flow in a first pump 126 fluidly coupled to the condenser 120 via the working fluid circuit 110, and pressurizing the second mass flow in a second pump 117 fluidly coupled to the condenser 120 via the working fluid circuit 110.

In the single-cycle mode, the method includes operating the heat engine system 100 by de-activating the second heat exchanger 104, the drive turbine 122, and the second pump 117, directing the working fluid from the condenser 120 to the first pump 126, and directing the working fluid from the first pump 126 to the first heat exchanger 102. The method may include de-activating the second recuperator 128 and directing the working fluid from the second pump 117 to the first recuperator 118 while switching to the single-cycle mode.

In other embodiments, the method includes operating the heat engine system 100 in the dual-cycle mode by further transferring heat via the first recuperator 118 from the first mass flow "$m_1$" downstream of the power turbine 116 and upstream of the condenser 120 to the first mass flow $m_1$ downstream of the second pump 117 and upstream of the first heat exchanger 102, transferring heat via the second recuperator 128 from the second mass flow "$m_2$" downstream of the drive turbine 122 and upstream of the condenser 120 to the second mass flow $m_2$ downstream of the first pump 126 and upstream of the second heat exchanger 104, and switching to the single-cycle mode further includes de-activating the second recuperator 128 and directing the working fluid from the second pump 117 to the first recuperator 118.

In some embodiments, the method further includes monitoring a temperature of the heat source stream 105, operating the heat engine system 100 in the dual-cycle mode when the temperature is equal to or greater than a threshold value, and subsequently, operating the heat engine system 100 in the single-cycle mode when the temperature is less than the threshold value. In some examples, the threshold value of the temperature of the heat source stream 105 is within a range from about 300° C. to about 400° C., such as about 350° C. In one aspect, the method may include automatically switching from operating the heat engine system 100 in the dual-cycle mode to operating the heat engine system 100 in the single-cycle mode with a programmable controller once the temperature is less than the threshold value. In another aspect, the method may include manually switching from operating the heat engine system 100 in the dual-cycle mode to operating the heat engine system 100 in the single-cycle mode once the temperature is less than the threshold value.

It is to be understood that the present disclosure describes several exemplary embodiments for implementing different features, structures, or functions of the disclosure. Exemplary embodiments of components, arrangements, and configurations are described herein to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, e.g., any element from one exemplary embodiment may be used in any other exemplary embodiment without departing from the scope of the disclosure.

Additionally, certain terms are used throughout the written description and claims for referring to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and the claims, the terms "including," "containing," and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit comprising a working fluid, wherein the working fluid comprises carbon dioxide and at least a portion of the working fluid circuit contains the working fluid in a supercritical state;

a first heat exchanger fluidly coupled to and in thermal communication with the working fluid circuit, configured to be fluidly coupled to and in thermal communication with a heat source stream, and configured to transfer thermal energy from the heat source stream to the working fluid within the working fluid circuit;

a second heat exchanger fluidly coupled to and in thermal communication with the working fluid circuit, configured to be fluidly coupled to and in thermal communication with the heat source stream, and configured to transfer thermal energy from the heat source stream to the working fluid within the working fluid circuit;

a first expander fluidly coupled to the working fluid circuit and the first heat exchanger and disposed downstream of the first heat exchanger;

a second expander fluidly coupled to the working fluid circuit and the second heat exchanger and disposed downstream of the second heat exchanger;

a first recuperator fluidly coupled to the working fluid circuit, the first expander, and the first heat exchanger, the first recuperator disposed downstream of the first expander and upstream of the first heat exchanger;

a second recuperator fluidly coupled to the working fluid circuit, the second expander, and the second heat exchanger, the second recuperator disposed downstream of the second expander and upstream of the second heat exchanger;

a condenser fluidly coupled to the working fluid circuit and the first and second recuperators and disposed downstream of the first and second recuperators;

a first pump fluidly coupled to the working fluid circuit, the condenser, and the first and second recuperators, the first pump disposed downstream of the condenser and upstream of the first and second recuperators;

a second pump fluidly coupled to the working fluid circuit, the condenser, and the first recuperator, the second pump disposed downstream of the condenser and upstream of the first recuperator; and a plurality of valves operatively coupled to the working fluid circuit and configured to switch the heat engine system between a dual-cycle mode, in which the first and second heat exchangers and the first and second pumps are active, and a single-cycle mode, in which the first heat exchanger and the first expander are active and at least the second heat exchanger and the second pump are inactive, wherein the second pump is a turbopump, the second expander is a drive turbine, and the drive turbine is coupled to the turbopump and operable to drive the turbopump when the heat engine system is in the dual-cycle mode.

2. The heat engine system of claim 1, wherein the plurality of valves includes a valve disposed between the condenser and the second pump, wherein the valve is closed during the single-cycle mode of the heat engine system and the valve is open when the heat engine system is in the dual-cycle mode.

3. The heat engine system of claim 1, wherein the plurality of valves includes a valve disposed between the first pump and the first recuperator, the valve configured to prohibit flow of the working fluid from the first pump to the first recuperator during the dual-cycle mode of the heat engine system and to allow flow of the working fluid therebetween during the single-cycle mode of the heat engine system.

4. The heat engine system of claim 1, wherein the plurality of valves further comprises:

a first valve operatively coupled to the working fluid circuit, disposed downstream of the first pump, and disposed upstream of the second recuperator;

a second valve operatively coupled to the working fluid circuit, disposed downstream of the second recuperator, and disposed upstream of the condenser;

a third valve operatively coupled to the working fluid circuit, disposed downstream of the first pump, and disposed upstream of the first recuperator;

a fourth valve operatively coupled to the working fluid circuit, disposed downstream of the second pump, and disposed upstream of the first recuperator; and a fifth valve operatively coupled to the working fluid circuit, disposed downstream of the condenser, and disposed upstream of the second pump.

5. The heat engine system of claim 4, wherein each of the first, second, fourth, and fifth valves is in an opened-position during the dual-cycle mode of the heat engine system and a closed-position during the single-cycle mode of the heat engine system, and the third valve is in an opened-position during the single-cycle mode of the heat engine system and a closed-position during the dual-cycle mode of the heat engine system.

6. The heat engine system of claim 4, further comprising a point on the working fluid circuit disposed downstream of the first and second recuperators and disposed upstream of the condenser, wherein the second valve is disposed upstream of the point and downstream of the second recuperator.

7. A heat engine system, comprising:

a working fluid circuit comprising a working fluid, wherein the working fluid comprises carbon dioxide and at least a portion of the working fluid circuit contains the working fluid in a supercritical state;

a first heat exchanger fluidly coupled to and in thermal communication with the working fluid circuit, configured to be fluidly coupled to and in thermal communication with a heat source stream, and configured to transfer thermal energy from the heat source stream to the working fluid within the working fluid circuit;

a second heat exchanger fluidly coupled to and in thermal communication with the working fluid circuit, configured to be fluidly coupled to and in thermal communication with the heat source stream, and configured to transfer thermal energy from the heat source stream to the working fluid within the working fluid circuit;

a first expander fluidly coupled to the working fluid circuit and the first heat exchanger and disposed downstream of the first heat exchanger;

a second expander fluidly coupled to the working fluid circuit and the second heat exchanger and disposed downstream of the second heat exchanger;

a first recuperator fluidly coupled to the working fluid circuit, the first expander, and the first heat exchanger, the first recuperator disposed downstream of the first expander and upstream of the first heat exchanger;

a second recuperator fluidly coupled to the working fluid circuit, the second expander, and the second heat exchanger, the second recuperator disposed downstream of the second expander and upstream of the second heat exchanger;

a condenser fluidly coupled to the working fluid circuit and the first and second recuperators and disposed downstream of the first and second recuperators;

a first pump fluidly coupled to the working fluid circuit, the condenser, and the first and second recuperators, the first pump disposed downstream of the condenser and upstream of the first and second recuperators;

a second pump fluidly coupled to the working fluid circuit, the condenser, and the first recuperator, the second pump disposed downstream of the condenser and upstream of the first recuperator; and a plurality of valves operatively coupled to the working fluid circuit and configured to switch the heat engine system between a single-cycle mode and a dual-cycle mode, wherein the plurality of valves further comprises:

a first valve operatively coupled to the working fluid circuit, disposed downstream of the first pump, and disposed upstream of the second recuperator;

a second valve operatively coupled to the working fluid circuit, disposed downstream of the second recuperator, and disposed upstream of the condenser;

a third valve operatively coupled to the working fluid circuit, disposed downstream of the first pump, and disposed upstream of the first recuperator;

a fourth valve operatively coupled to the working fluid circuit, disposed downstream of the second pump, and disposed upstream of the first recuperator; and a fifth valve operatively coupled to the working fluid circuit, disposed downstream of the condenser, and disposed upstream of the second pump, wherein each of the first, second, fourth, and fifth valves is in an opened-position during the dual-cycle mode of the heat engine system and a closed-position during the single-cycle mode of the heat engine system, and the third valve is in an opened-position during the single-cycle mode of the heat engine system and a closed-position during the dual-cycle mode of the heat engine system.

8. The heat engine system of claim 7, further comprising a point on the working fluid circuit disposed downstream of the first and second recuperators and disposed upstream of the condenser, wherein the second valve is disposed upstream of the point and downstream of the second recuperator.

9. The heat engine system of claim 7, wherein the second pump is a turbopump, the second expander is a drive turbine, and the drive turbine is coupled to the turbopump and operable to drive the turbopump during the dual-cycle mode of the heat engine system.

10. A method for recovering energy from a heat source, comprising:

operating a heat engine system in a dual-cycle mode, comprising:

heating a first mass flow of a working fluid in a first heat exchanger fluidly coupled to and in thermal communication with a working fluid circuit and a heat source stream, wherein the first heat exchanger is configured to transfer thermal energy from the heat source stream to the first mass flow of the working fluid within the working fluid circuit, the working fluid comprises carbon dioxide, and at least a portion of the working fluid circuit contains the working fluid in a supercritical state;

expanding the first mass flow in a first expander fluidly coupled to the first heat exchanger via the working fluid circuit;

heating a second mass flow of the working fluid in a second heat exchanger fluidly coupled to and in thermal communication with the working fluid circuit and the heat source stream, wherein the second heat exchanger is configured to transfer thermal energy from the heat source stream to the second mass flow of the working fluid within the working fluid circuit;

expanding the second mass flow in a second expander fluidly coupled to the second heat exchanger via the working fluid circuit;

at least partially condensing the first and second mass flows in one or more condensers fluidly coupled to the working fluid circuit;

pressurizing the first mass flow in a first pump fluidly coupled to the condenser via the working fluid circuit;

pressurizing the second mass flow in a second pump fluidly coupled to the condenser via the working fluid circuit;

transferring heat via a first recuperator from the first mass flow downstream of the first expander and upstream of the condenser to the first mass flow downstream of the second pump and upstream of the first heat exchanger; and transferring heat via a second recuperator from the second mass flow downstream of the second expander and upstream of the condenser to the second mass flow downstream of the first pump and upstream of the second heat exchanger; and switching the heat engine system from the dual-cycle mode to a single-cycle mode, comprising:

de-activating the second heat exchanger, the second expander, and the second pump;

directing the working fluid from the condenser to the first pump;

directing the working fluid from the first pump to the first heat exchanger; and de-activating the second recuperator and directing the working fluid from the second pump to the first recuperator.

11. The method of claim 10, further comprising:

monitoring a temperature of the heat source stream;

operating the heat engine system in the dual-cycle mode when the temperature is equal to or greater than a threshold value; and operating the heat engine system in the single-cycle mode when the temperature is less than the threshold value.

12. The method of claim 11, further comprising automatically switching from operating the heat engine system in the dual-cycle mode to operating the heat engine system in the single-cycle mode with a programmable controller once the temperature is less than the threshold value, wherein the threshold value of the temperature is within a range from 300° C. to 400° C.

13. The method of claim 11, further comprising manually switching from operating the heat engine system in the dual-cycle mode to operating the heat engine system in the single-cycle mode once the temperature is less than the threshold value, wherein the threshold value of the temperature is within a range from 300° C. to 400° C.

* * * * *